US006374495B1

(12) United States Patent
Lackler et al.

(10) Patent No.: US 6,374,495 B1
(45) Date of Patent: Apr. 23, 2002

(54) APPARATUS AND METHOD FOR SECURING BORDERWIRES TO MATTRESS INNERSPRINGS

(75) Inventors: Paul Lackler, Elmhurst; Joseph Chandler, Aurora, both of IL (US)

(73) Assignee: Stanley Fastening Systems, New Britain, CT (US)

( * ) Notice: Subject to any disclaimer, the term of this patent is extended or adjusted under 35 U.S.C. 154(b) by 0 days.

(21) Appl. No.: 09/524,363

(22) Filed: Mar. 14, 2000

(51) Int. Cl.[7] ..... B21F 35/00; B23P 19/04; B23P 11/00

(52) U.S. Cl. ..... 29/896.92; 29/227; 29/243.56; 29/712

(58) Field of Search ..... 29/896.92, 91, 29/243.56, 227, 709, 712; 140/3 CA, 93 D

(56) References Cited

U.S. PATENT DOCUMENTS

| | | | |
|---|---|---|---|
| 3,789,495 | A | 2/1974 | Stumpf |
| 4,480,383 | A | 11/1984 | Yoshioka et al. |
| 4,553,324 | A | 11/1985 | Zapletal et al. |
| 4,608,740 | A | 9/1986 | Bloys et al. |
| 4,724,590 | A | 2/1988 | Langas et al. |
| 4,815,182 | A | 3/1989 | Langas et al. |
| 4,829,643 | A | 5/1989 | Ayres et al. |
| 4,907,327 | A | 3/1990 | Ayres et al. |
| 5,054,178 | A | 10/1991 | Züger |
| 5,497,541 | A | 3/1996 | Nogueira |

FOREIGN PATENT DOCUMENTS

| | | |
|---|---|---|
| WO | WO 97/44275 | 11/1997 |

*Primary Examiner*—P. W. Echols
(74) *Attorney, Agent, or Firm*—Fitch, Even, Tabin & Flannery

(57) ABSTRACT

An apparatus and method are provided for applying clips to mattress spring assemblies in a highly accurate and fast manner via operating or positioning members that properly position the innerspring coils relative to the borderwires for clipping thereof. Improperly positioned innersprings have their end coils shifted past the borderwires as they travel downstream to be clipped by the apparatus and method herein. In this manner, the positioning members are operable to use the progression of the spring assemblies as they are driven downstream to properly position the innerspring coils relative to the borderwires for being clipped thereto. Preferably, there is at least one positioning member disposed upstream from the clip applicator tool such as in a positioning station that acts to cause the end turns of the mattress innerspring coils as the innersprings move into engagement therewith, to progressively shift into the predetermined clipping orientation that is necessary for proper clipping of the end turns to the borderwires. The positioning member does not have to be cycled between operative and inoperative positions for each clip that is applied thus speeding the overall clipping process for the spring assembly.

38 Claims, 20 Drawing Sheets

55
12
14
14
31
54

12a
14a
12b
48a
62
60
62
60
68
64

12a
12b
58
41
54
45

45
44
28
28
34
98
30
70
24
96
108
108
106
104
106
70
102

11
12
13
15
20
31
45
38
90
92
93
89
12a
14
19
40
42
18

31
17
17
40
19
89
12b 94
100
30

94
100
30

14
32
18A
20
93
42
42
19
18A
32

10a 160
144
29
36
62
62
62
64
60
68
102

57

59
POWER
128
COIL SENSOR INDICATOR
142
TOOL JAM RELEASE
140
126
126
RAISE TOOLS
138
126
RESET CYCLE
136
122
124
TOOLS
ON
OFF
134
START CYCLE
132
STOP CYCLE
130

APPARATUS AND METHOD FOR SECURING BORDERWIRES TO MATTRESS INNERSPRINGS

FIELD OF THE INVENTION

The invention relates to an apparatus and method for assembly of mattress spring assemblies, and more particularly, to an apparatus and method for automatically applying clips to borderwires extending about mattress innersprings.

BACKGROUND OF THE INVENTION

Mattress spring assembly clipping machines are known that automatically apply clips onto borderwires and mattress innersprings that are preassembled via helical wires to form a matrix of innersprings and by clipping the corner innersprings to the borderwires. These known machines use a driven pusher assembly that advances the preclipped mattress spring assemblies along the frame in a ha generally vertical orientation supported by way of an inclined wall. Clip applicator tools are provided at a lower cutout along the wall at a clipping station so that as the spring assembly is advanced between the tools, they are timed to be fired to apply the clips by clinching them about the borderwires and the ends of the innersprings adjacent thereto.

While these vertical-type of automatic clipping machines have proven to be much faster than manual application of the clips as by a worker who holds an applicator tool and positions it for manual firing to apply the clip, a significant limitation on their cycle times is the need to have the borderwires and innersprings in proper orientation relative to each other for clipping to occur successfully. It is generally true that in the preclipped spring assemblies, a good percentage of the inner or coil springs will have their end coils or turns disposed outward beyond the borderwires. However, for clipping to be successful, the end turns of the coil springs need to be disposed inwardly of the borderwires, and accordingly, the automatic clipping machines generally utilize a positioning mechanism to orient the borderwires and end coils in the appropriate clipping orientation. This problem of properly positioning the borderwires and innersprings in their proper clipping orientation can be exacerbated by the wide variety of different sizes and types of mattress spring assemblies that the machine needs to be able to handle. In other words, the machine should be able to clip spring assemblies for twin, full, queen and king size mattresses while also being able to deal with spring assemblies of the same size that have different types, sizes, and numbers of springs used therewith.

In many prior machines, the positioning mechanism utilizes some sort of side pusher device at the clipping station that is activated to push the end turns of the coil springs toward each other and past the borderwires. One significant limitation with these prior positioning mechanisms is that they have to be retracted each time the spring assembly is indexed to the next innerspring for its clipping to avoid interfering with the travel of the spring assembly. As is apparent, this cycle of actuating and retracting the positioning device slows down the entire cycle time for the machine undesirably lowering the production rates that can be obtained therewith.

Another prior machine disclosed in PCT publication WO 97/44275 has spreader pins that are operable to pull the borderwires away from each other and from the end turns of the coil springs. The spreader pins are not retracted after each clip is applied and thus do not cause the problems of the previously-described positioning mechanisms that have to be retracted with each coil that is clipped. However, the pulling action of the spreader pins on the borderwires creates several undesirable problems. First, unlike the coil springs which are specifically designed to be axially compressed, the borderwires are not intended to be pulled apart from each other as contemplated with the '275 machine. Accordingly, pulling the borderwires apart takes much more force than pushing on the coil springs. Further, where the machine is clipping high density mattress spring assemblies, e.g. 600 coil springs for a full size spring assembly, aligning and fitting the spreader pins between adjacent barrels of the closely spaced coil springs can be highly problematic. Should the spreader pins get caught in a coil spring, the machine will have to be stopped to untangle the spring assembly from the spreader pin(s) with the clipping process then restarted with this downtime slowing down production. In addition, where the coil springs are of the "open-coil" variety where their end coils have a cut end so that they are not closed to form a complete circular end coil, it is more likely that the end coil can wrap itself around the borderwire as the mattress assembly is put together via preclipping and moved to the automatic clipping machine. In this instance, pulling the borderwires with the spreader pins can destroy the coil spring having its cut end wrapped about the wire. Another problem is that the operation of the spreader pins too close to the preclipped corner innersprings may weaken or pull the clips off these preclipped corners. In practice it has been found that the machine has to start and stop clipping three or four coils spaced from the preclipped corners to avoid pulling the preclipped end turns apart from the borderwires.

Accordingly, there is a need for a high-speed automatic clip applying machine for mattress spring assemblies. More particularly, there is a need for a high-speed machine that positions the borderwires and coil innersprings in a proper clipping orientation and allows an entire side or end of the spring assembly to be automatically clipped in a highly accurate manner.

SUMMARY OF THE INVENTION

In accordance with the present invention, an apparatus and method are provided for applying clips to mattress spring assemblies in a highly accurate and fast manner via operating or positioning members that properly position the innerspring coils relative to the borderwires for clipping thereof, viz. with the end turns of the innerspring coils disposed inwardly relative to adjacent borderwires in a predetermined clipping orientation. Improperly positioned innersprings have their end coils shifted past the borderwires as an incident of being advanced downstream to be clipped by the apparatus and method herein. In this manner, the positioning members are operable to use the progression of the spring assemblies as they are driven downstream in the automatic clipping machine to properly position the innerspring coils relative to the borderwires for being clipped thereto. More particularly, there is at least one positioning member disposed upstream from the clip applicator tool such as in a positioning station that acts to cause the end turns of the mattress innerspring coils as the innersprings move into engagement therewith, to progressively shift into the predetermined clipping orientation that is necessary for proper clipping of the end turns to the borderwires. The positioning member does not have to be cycled between operative and inoperative positions for each clip that is applied thus speeding the overall clipping process for the spring assembly.

In the preferred form, the at least one positioning member includes a lift member that is affixed to the lower support of the clipping machine so that bottoms of portions of the innerspring coils intermediate the end turns thereof ride thereover. As the innerspring intermediate portions engage the lift member and continue their downstream travel, they progressively rise up a ramp surface of the lift member which causes the end turns to be lifted over the borderwires. The at least positioning member further includes cam members that engage the lifted end coils and progressively push them in the transverse direction with continuing downstream travel of the spring assembly. Thus, the lift member raises the end coils to clear the borderwires while at the same time the cam members push the end coils past the borderwires so that they are shifted from an outward disposition relative to the borderwires to the preferred inward disposition relative thereto. It has also been found that the lifting action of the lift member advantageously causes the end turns not riding up the ramp surface to be drawn or canted toward each other due to their attachment in the innerspring matrix via the helical wires, as will be described more fully hereinafter. Accordingly, the lift member can also impart a component of the desired transverse shifting of the end turns.

The lift member is also preferably provided with a down ramp so that the end coils are lowered to the predetermined clipping orientation after they have shifted transversely to be disposed inwardly relative to the borderwires, and the cam members have guide portions that maintain the end coils in their predetermined clipping orientation until they reach the clipping tools. As described above, the lift and cam members do not shift once clipping begins along a side or end of the spring assembly to allow for much more rapid production of clipped spring assemblies with the apparatus and method herein as there is no time wasted for allowing the operating members to undergo cycling for each clip that is applied. Instead, the primary limitation on production speed is the time the spring assembly must be pausing while the clip applicator tools are fired for applying clips about the innerspring end coils and borderwires; accordingly, completely clipped mattress spring assemblies can be produced with the present apparatus and method as fast as the clip applicator tools will allow recognizing that the spring assembly must be stopped as each clip is applied.

Alternatively, the cam members can cooperate with restraining members which keep the borderwires in a substantially fixed position in the transverse direction. This allows the cam member to progressively push the end coils disposed outwardly relative to the adjacent borderwires against and past the restrained borderwire so that the end coils will be disposed inwardly relative to the borderwires in the predetermined clipping orientation. In either instance whether utilizing the lift member to raise the end coils to clear the borderwires or the restraining members to hold the borderwires against transverse shifting, there is no pulling on the borderwires to deflect it transversely and the attendant problems therewith such as in terms of the timing accuracy necessary with activating the pulling members to fit between coils, especially in high density spring assemblies, and having to stop the clipping process prematurely to avoid damaging the preclipped corners.

Accordingly and in one form of the invention, an apparatus for automatically clipping mattress spring assemblies is provided including a frame having portions for supporting spring assemblies in a generally vertical orientation. A drive mechanism advances the spring assemblies in their vertical orientation in a downstream travel direction along the frame portions for being clipped. A clipping tool is provided for securing clips about borderwires and springs for clipping the spring assembly together. There is at least one positioning member upstream from the clipping tool which engages and shifts the innersprings past the borderwires in a direction transverse to the downstream direction as an incident of being advanced in the downstream travel direction. Accordingly, the apparatus herein utilizes the natural progression of the spring assemblies in the downstream travel direction to cause the desired shifting of the innersprings in a direction transverse to the downstream travel direction past the borderwires. The present apparatus avoids pulling on the borderwires as with prior machines and the previously described shortcomings associated therewith.

In a preferred form, the at least one positioning member includes a lift member and an arm member which cooperate to shift the innersprings past the borderwires in the transverse direction as the spring assemblies travel in the downstream direction.

In another form of the invention, a pushing mechanism for an automatic clipping apparatus having a clipping station is provided. The pushing mechanism includes a first portion upstream from the clipping station for engaging innersprings that are not in the desired predetermined clipping orientation relative to the borderwires as the mattress spring assemblies advance in a downstream direction toward the clipping station. The first portion extends in a direction transverse to the downstream direction to push the innersprings past the borderwires in the transverse direction for positioning the innersprings in the predetermined clipping orientation as an incident of being advanced in the downstream direction. A second portion of the pushing mechanism extends from upstream of the clipping station and has an end thereof in the clipping station to keep the innersprings in the predetermined clipping orientation during downstream travel of the spring assembly to the clipping station.

In a preferred form, the first and second portions are integral with each other.

Preferably, the end of the second portion is disposed above a clipping tool in the clipping station. In this manner, the pushing mechanism ensures that the predetermined clipping orientation is maintained until the clip is applied.

In one form, the pushing mechanism is provided in combination with a lifter mechanism for raising the innersprings to clear the borderwires to allow the first portion to push the innersprings in the transverse direction substantially without encountering interference from the borderwires.

In another form, the pushing mechanism is provided in combination with a restraining mechanism for keeping the borderwire in a substantially fixed transverse position as the first portion pushes the innersprings in the transverse direction against and past the borderwires.

In the preferred form of the invention, there is provided a frame, a drive mechanism for advancing spring assemblies downstream along the frame, and applicator tools for securing clips about borderwires at either end turn of the innerspring coil that are in a predetermined clipping orientation relative to each other. A lift member is provided having a ramp surface upwardly inclined in the downstream direction for raising the innersprings so that the end coils clear the borderwires. Arm members are provided having cam portions so that with the arm members in operative positions the cam portions progressively urge engaged end turns of the coils axially toward each other as the spring assembly is advanced in the downstream direction for cooperating with the lift member to shift the end coils toward the predetermined clipping orientation. A controller keeps the arm members in their operative positions without shifting to inoperative positions thereof as the spring assembly is advanced through the clipping station and clips are applied to the unclipped coils along an entire side or end of the spring assembly.

It should be noted that because the mattress spring assemblies are typically preclipped at their corners when referencing that the machine herein clips an entire side or end of the spring assembly, this references the unclipped perimeter coils between the preclipped corner coils along the side or end of the spring assembly.

In one form, a sensor is provided for detecting the spring assembly and sending a signal to the controller for operating the applicator tools and the arm members. The controller upon receiving the sensor signal causes the arm members to shift to their operative positions, the drive mechanism to pause with the borderwires and innersprings in the predetermined clipping orientation at the clipping station, the applicator tools to fire with the arm members maintained in their operative positions, and the drive mechanism to restart to continue advancing the spring assembly downstream.

In another form of the invention, an automatic clip applying apparatus is provided including a frame, a drive mechanism for advancing spring assemblies in a downstream travel direction, and a clipping station including at least one applicator tool. A lifting mechanism is provided upstream of the clipping station for raising portions of the innerspring intermediate the ends thereof to shift the ends past the borderwires in a direction transverse to the downstream direction.

In a preferred form, the apparatus includes a cam member which is actuated to an operative position to push the innersprings past the borderwires in the transverse direction as an incident of the downstream travel of the spring assembly. A sensor detects the spring assembly for shifting the cam member from an inoperative position thereof to its operative position with the cam member staying in the operative position until the drive mechanism has advanced an entire side of the end of the mattress spring assembly past the lifting mechanism.

In yet another form of the invention, an apparatus is provided for automatically applying clips to mattress spring assemblies including borderwires extending about mattress innersprings. The apparatus includes a frame having portions for supporting spring assemblies in a generally vertical orientation. A drive mechanism advances the spring assemblies in their vertical orientation in a downstream travel direction along the frame for being clipped. A clipping station including at least one applicator tool secures clips about borderwires and coils for clipping the spring assembly together. A positioning station is provided upstream from the clipping station and includes at least one operating member which is actuated to an operative position to push the innersprings past the borderwires in a direction transverse to the downstream direction as an incident of being advanced in said downstream travel direction through the positioning station. A sensor detects the spring assembly for shifting the operative member from an inoperative position thereof to its operative position. The operating member stays in the operative position until the drive mechanism has advanced an entire side or end of the mattress spring assembly through the positioning station. In this manner, the apparatus does not slow production by causing its operating member to undergo repeated cycling from inoperative to operative positions thereof while clipping a side or end of the spring assembly. Accordingly, the speed at which the spring assemblies can be driven through the positioning station and the rate of production of completely clipped spring assemblies can be increased with the above-described apparatus.

In one form, the operating member includes an arm having an arcuate portion which engages the innersprings and progressively urges them past the borderwires in the transverse direction as the drive mechanism advances the spring assembly through the positioning station. Preferably, the arm includes a straight portion downstream from the arcuate portion with the arm in the operative position to keep the innerspring pushed past the borderwires as they exit the positioning station.

In another form, the at least one operating member can include at least one finger having an operative position and a restraining portion which keeps the borderwires from being shifted with the pushed innersprings with the finger in the operative position. The finger is advantageous because it does not pull on the borderwire. Instead, the finger serves to guide the borderwire so that it continues to travel in its substantially undeformed state despite the occurrence of the pushing action on the innersprings.

Preferably, the at least one operating member includes a pair of arms mounted relative to the frame so that the mattress spring assembly is advanced between the arms with the respective arms pushing the innersprings in oppositely-directed transverse directions, and a pair of fingers each mounted adjacent one of the arms operable to hold the borderwires in a substantially fixed transverse position as advanced through the positioning station.

In one form, the sensor is disposed upstream of the clipping station, and a controller is provided for receiving a signal from the sensor indicating detection of the spring assembly and using a time delay or distance measurement before actuating the applicator tool for allowing the drive mechanism to advance the spring assembly downstream to the clipping station.

In another aspect of the invention, a method is provided for automatically securing borderwires to innersprings of mattress spring assemblies including providing a preclipped spring assembly having end turns of corner coils clipped to the borderwires, advancing the spring assembly in a substantially vertical orientation in a downstream travel direction so that the coils extend between the ends thereof transverse to the travel direction, progressively shifting the ends of the coils in a direction transverse to the travel direction as the spring assembly advances in the travel direction for orienting the coil ends and borderwires in a predetermined clipping orientation, and clipping the ends of the coils to the borderwires in their predetermined clipping orientation.

In one form, the innerspring ends are progressively shifted in the transverse direction by raising portions of the innersprings intermediate the ends thereof and drawing the innerspring ends toward each other.

In another form, the method includes lifting the coil ends up and over the borderwires to shift the ends toward the predetermined clipping orientation.

In a preferred form, the innerspring ends are progressively shifted in the transverse direction by raising portions of the coils intermediate the ends thereof and pushing the ends in the transverse direction as the spring assembly travels in the downstream direction. Preferably, the method includes lowering the coils so that the ends and borderwires are in the predetermined clipping orientation and guiding the shifted coil ends to maintain the predetermined clipping orientation for clipping.

In one form, the method includes restraining the borderwires from shifting in the transverse direction so that the progressive pushing of the ends of the coils pushes the innerspring ends against and past the restrained borderwires into the predetermined clipping orientation.

DETAILED DESCRIPTION OF THE PREFERRED EMBODIMENTS

Figure 8:
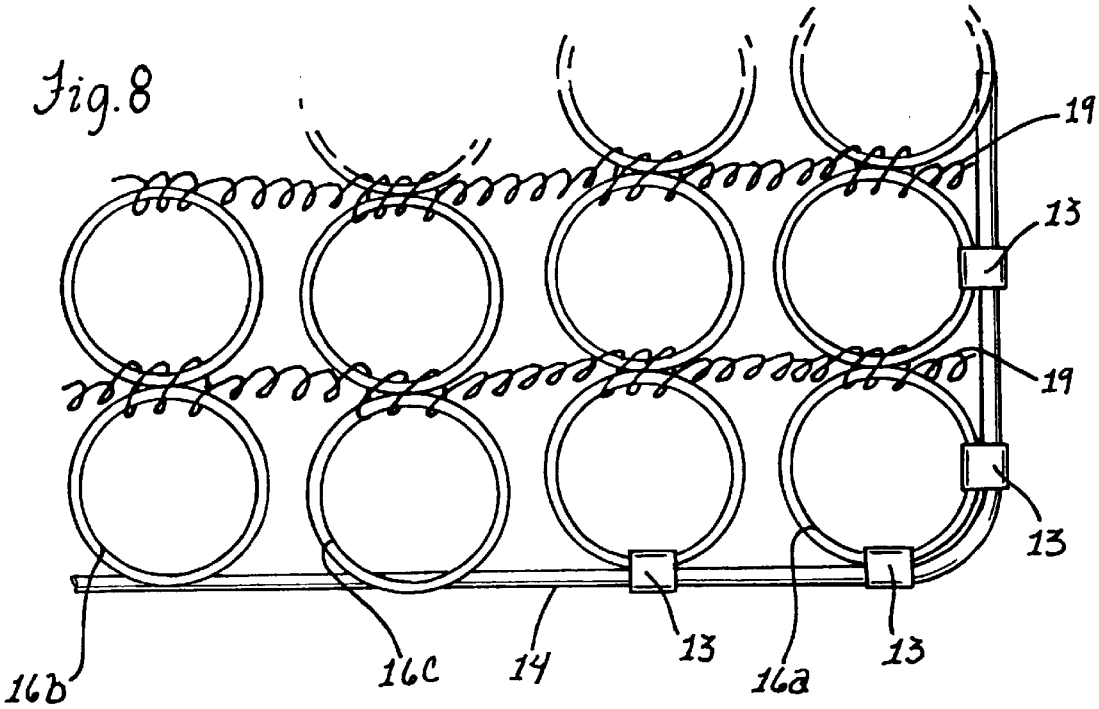
FIG. 8 is a fragmentary elevational view of a spring assembly having end turns of innerspring coils adjacent to and at the corner of one of the borderwires preclipped thereto.
Figure 9:
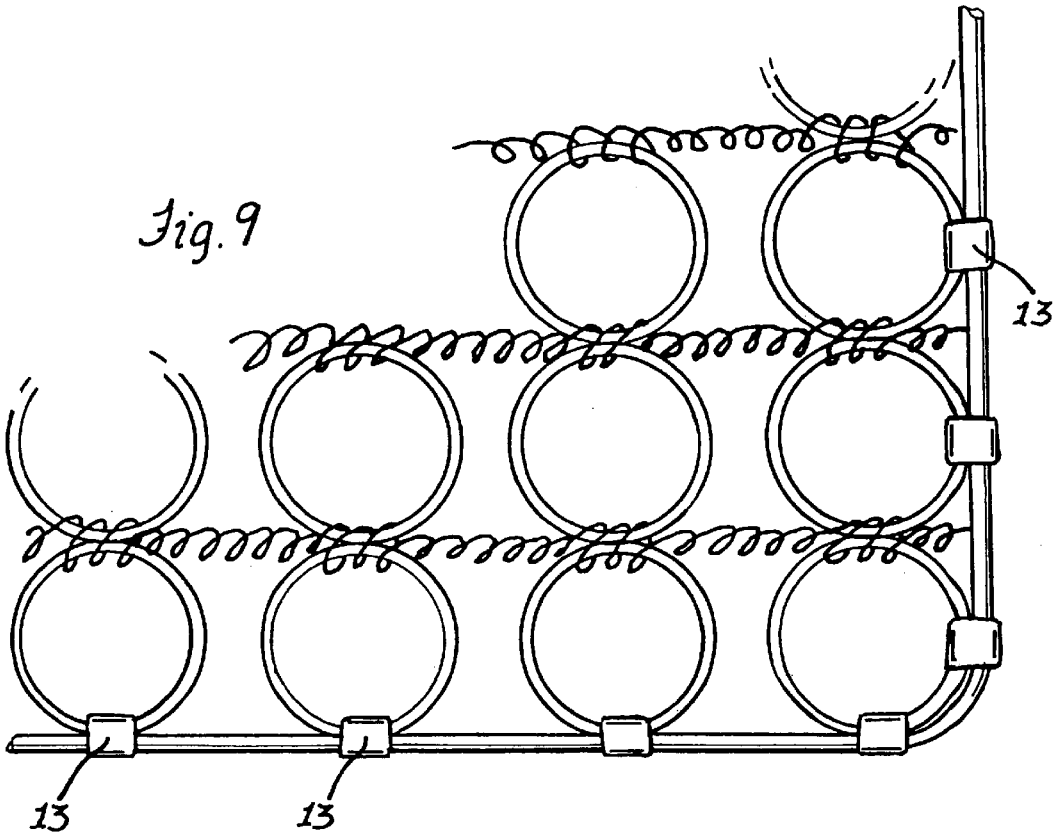
FIG. 9 is a view similar to FIG. 8 showing the remaining end turns clipped to the borderwire.

FIGS. 1–4 show an automatic clipping machine or apparatus 10 for automatically clipping together mattress spring assembly units 12 such as with clips 13 including borderwires 14 that extend about a matrix of mattress innersprings 16. Referring to FIG. 8, the spring assembly units 12 are partially preassembled by preclipping the corner innersprings 16*a* and adjacent innersprings 16 to the corners of the borderwires 14 at the juncture of sides 12*a* and ends 12*b* of the units 12. The innersprings 16 are typically wound about an axis 18 as in the form of coil springs. The coil springs 16 can be held together in their matrix by helically wound wires 19 or the like. With the spring assembly units 12 preclipped at the corner coil springs 16*a*, many of the remaining coil springs 16 about the perimeter of the innerspring matrix and adjacent the borderwires 14 will have their end turns or coils 20*a* and 20*b* disposed outwardly past the borderwires 14 when placed in machine 10 for clipping, such as coils 16*b* and 16*c* in FIG. 8.

Figure 7:
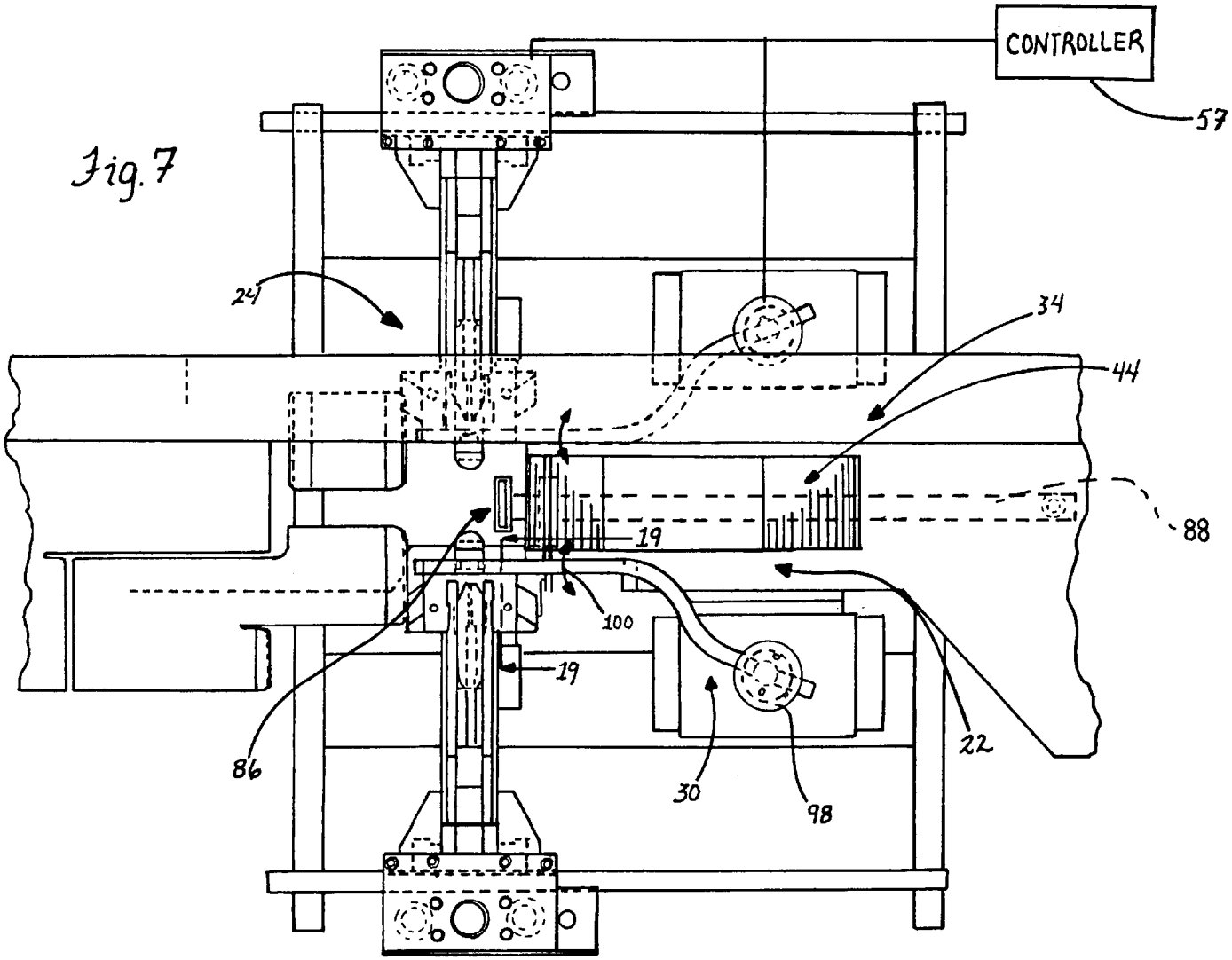
FIG. 7 is a plan view of the operating area showing arm members including arcuate portions thereof pivoted to their operative position and a lift member having a ramp surface for engaging bottoms of the innerspring coils.

To position the end turns 20 inwardly of the corresponding borderwires 14*a* and 14*b* in the desired predetermined orientation for being properly clipped, the present machine 10 has a positioning station 22 upstream from a clipping station 24 along frame 26 of the machine 10, as can be seen in FIG. 7. The stations 22 and 24 together form the main operating area 25 of the machine 10. The positioning station 22 includes at least one operating or positioning member, generally designated 28, that acts to properly position the end coils 20 relative to the borderwires 14 before they reach the clipping station 24. Importantly, the operating members 28 are not shifted between operative and inoperative positions thereof during the clipping process for the perimeter coils along an entire side 12*a* or end 12*b* of the spring assembly unit 12 and as the spring unit 12 is driven for travel in the downstream direction 31 along the frame 26. In this manner, production rates for the present machine 10 are increased as there is no time wasted in having to shift or retract the operating members 28 to an inoperative position after each coil 16 has been clipped. In addition, the present operating members 28 provide highly accurate and repeatable positioning of the coil innersprings 16 and borderwires 14 in their predetermined clipping orientation regardless of the size and/or density of the matrix of coil springs 16. To this end, downstream travel of the spring units 12 through the positioning station 22 including the positioning members 28 is effective to shift those end coils 16 that are disposed outward of the borderwires 14 such as coils 16*b* and 16*c* (FIG. 8) inwardly and past the borderwires 14 into the predetermined clipping orientation. Advantageously, the positioning members 28 do not require deflecting or pulling on the borderwires 14 and instead utilize the driving force applied to the spring units 12 as they are advanced downstream along the frame 26 to cause the desired end coil shifting and positioning. In a preferred form and as will be described more fully herein, the present apparatus 10 and method also utilize the fact that the end coils 20 are tied together in a matrix by the helical wires 19 to contribute in achieving the end coil shifting.

Figure 5:
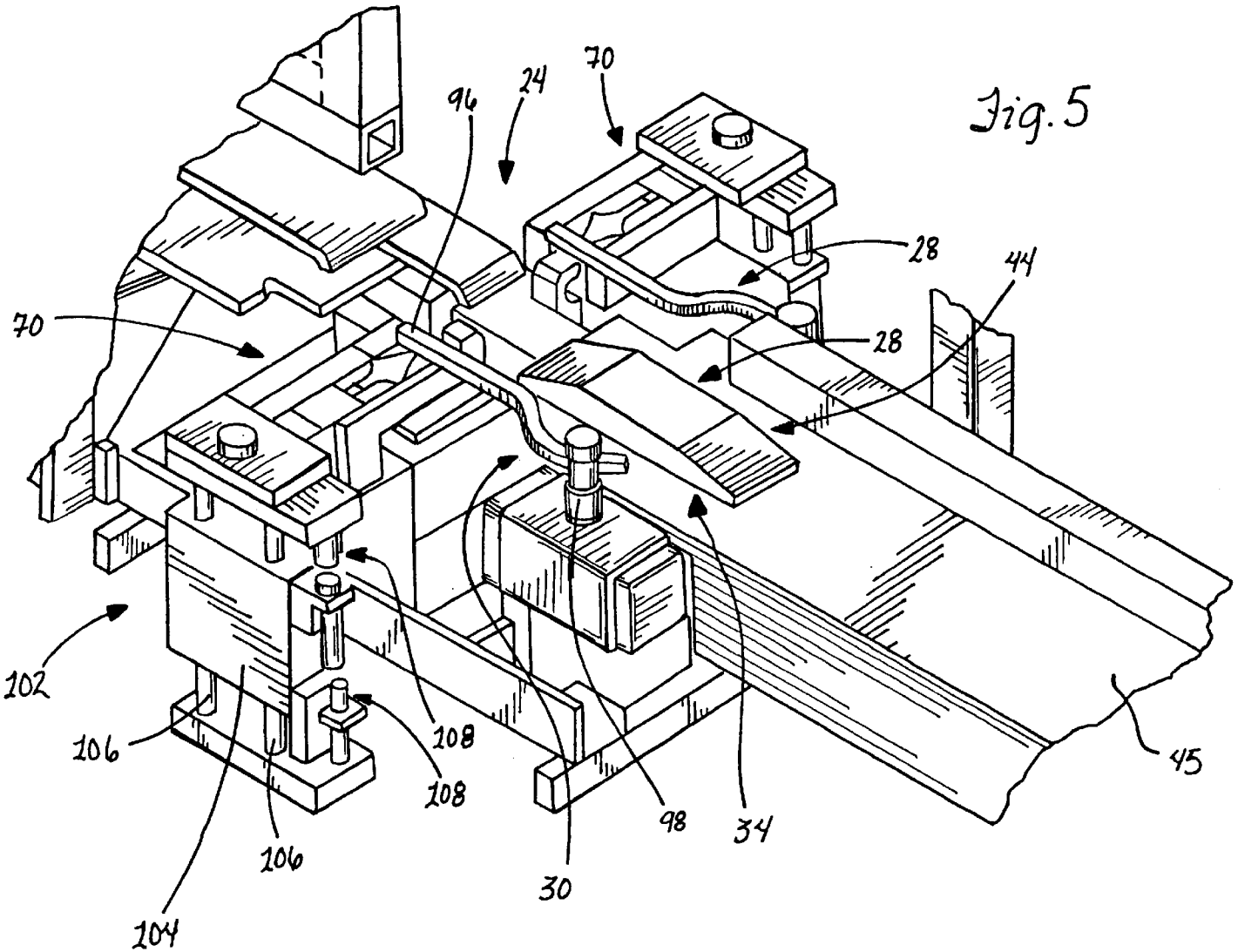
FIG. 5 is an enlarged fragmentary perspective view of the operating area showing applicator tools in a clipping station and operating members in a positioning station substantially disposed upstream from the clipping station.
Figure 6:
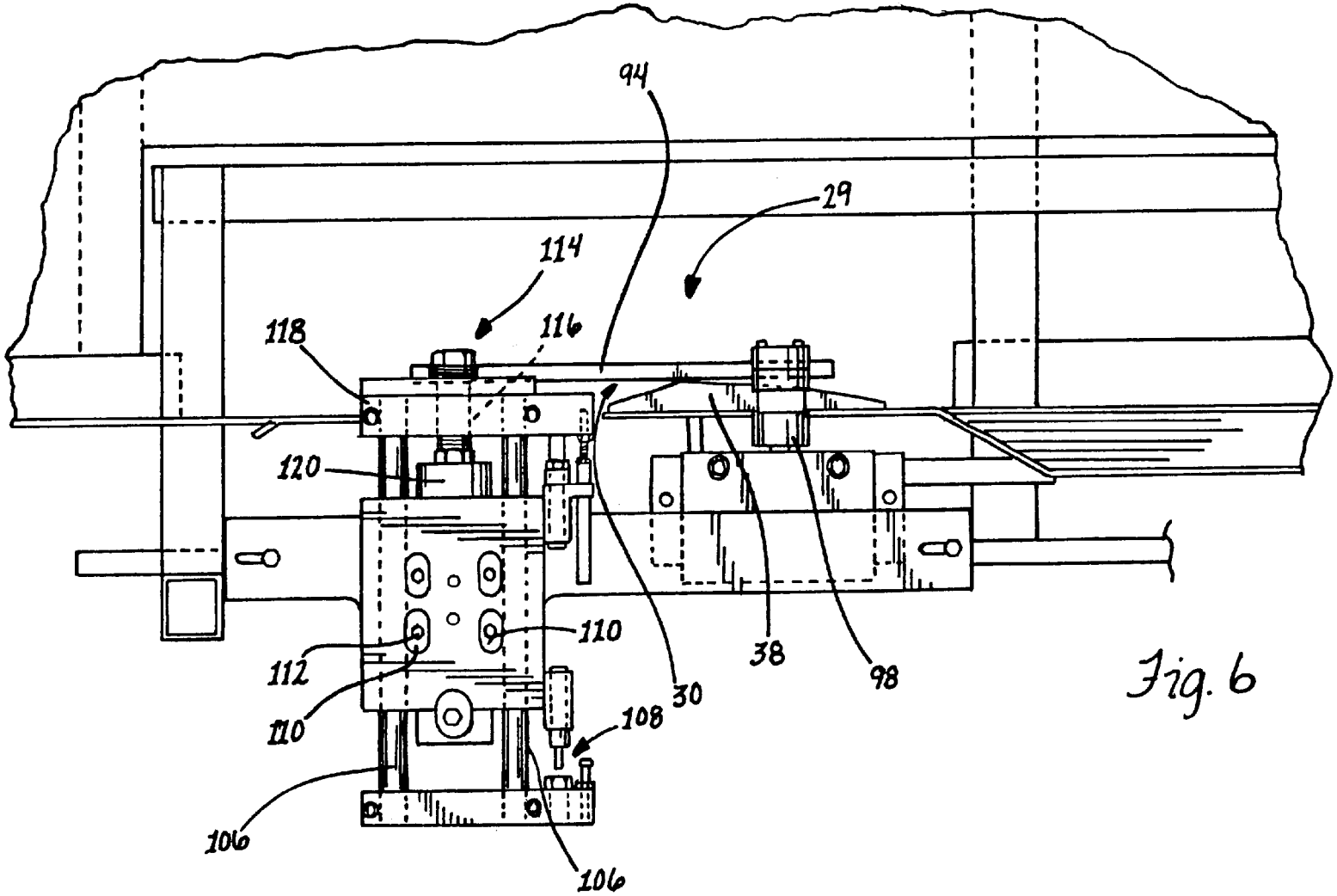
FIG. 6 is an elevation view of the operating area showing an adjustment cylinder for the applicator tool to allow different spring assemblies to be clipped with the apparatus.

More specifically, the positioning station 22 has a pushing mechanism 29 in the form of cam or arm members 30 of the operating members 28, as best seen in FIGS. 5–7. The arms 30 can each include a cam portion 32 that extends transverse to the downstream travel direction 31 of the spring units 12. As shown, the cam portions 32 preferably have an arcuate shape so that the arms 30 are bowed inwardly upstream against the direction of travel of the spring assembly unit 12 when the arm 30 is in its operative position, shown in FIG. 7. In this manner, as the end turns 20 that are disposed beyond the adjacent borderwires 14 travel in the downstream direction to the positioning station 22, they can engage against the arm cam portion 32. The curvature of the arm cam portion 32 will act to progressively push the end turns 20 in a direction transverse to the downstream travel direction, i.e. in the transverse or axial direction as indicated by arrow 33 (see FIG. 13) compressing the coil springs 16 along their axis 18. Accordingly, continued downstream travel of the spring assembly unit 12 causes the end turns 20 of a particular coil spring 16 to be progressively urged inwardly toward each other and toward the desired predetermined clipping orientation where the end turns 20 are disposed axially inward of the adjacent borderwires 14 after they exit the positioning station 22 for being clipped at the clipping station 24, as described more fully hereinafter.

The positioning station 22 can also include a lifting mechanism 34 as best shown in FIGS. 5–7 and 10–18 or a restraining mechanism 36 as best seen in FIGS. 23–26, which cooperate with the cam members 30 to shift the end coils 20 to the predetermined clipping orientation. With respect to the lifting mechanism 34, the positioning members 28 include a lift member 38 of the lifting mechanism 34 with the member 38 being affixed to the machine frame 26 in the positioning station 22 upstream from the clipping station 24. The lift member 38 is operable to engage bottoms 40 of the innersprings 16, and in particular those of coils 42 intermediate the end coils 20, as the spring unit 12 is driven downstream along the frame 26 and via ramp surface 44 to raise the innersprings 16. The ramp surface 44 extends at an upward incline in the downstream direction 31 so that as the spring units 12 are advanced downstream the innersprings 16 thereof riding on the ramp 44 progressively rise. Although the end coils 20 do not ride up the surface 44, the lifting action imparted to the intermediate coils 42 is sufficient to cause the end coils 20 to be shifted upward so that they substantially clear the tops of the borderwires 14.

At this time, the arcuate portions 32 of the cam arms 30 begin to shift the end coils 20 in the direction 33 transverse to the travel direction 31 and with continued downstream travel of the unit 12, the portions 32 will act to shift the end coils 20 so that they are disposed inward of the adjacent borderwire 14. As is apparent, the apparatus 10 including the positioning members 28 is effective to shift the end coils 20 that are out of position disposed outward of the borderwires 14 so that they are inwardly disposed relative thereto as an incident of the downstream travel of the spring unit 12 and without requiring cycling of the members 28 while an entire side 12*a* or end 12*b* of a unit 12 is advanced through the positioning station 22.

To more specifically describe the apparatus 10 and method of automatically clipping spring units 12 therewith, continuing reference will be made to FIGS. 1–4. As illustrated, the machine 10 has a lower ledge wall 45 and an upper inclined wall 46 that is angled slightly from the vertical. The walls 45 and 46 together have a generally L-shape in profile and cooperate to support the spring units 12 in a substantially vertical orientation during the clipping process described herein. In this regard, the lower support wall 45 has a transverse width sufficient so that both borderwires 14 along sides 12*a* or ends 12*b* of the unit 12 are supported thereon. A space 48 is provided between the lower support wall 45 and inclined wall 46. Drive 50 for the machine 10 includes a drive track 52 that extends lengthwise in the space 48 in the downstream direction 31 and a pusher assembly 54 that reciprocates along the drive track 52 for driving the spring unit 12 in the downstream travel direction 31. An encoder 55 operably connected to the drive 50 provides information as to the precise position of the pusher assembly 54 and thus the spring assembly 12 in its downstream travel along the machine frame 26.

Figure 1:
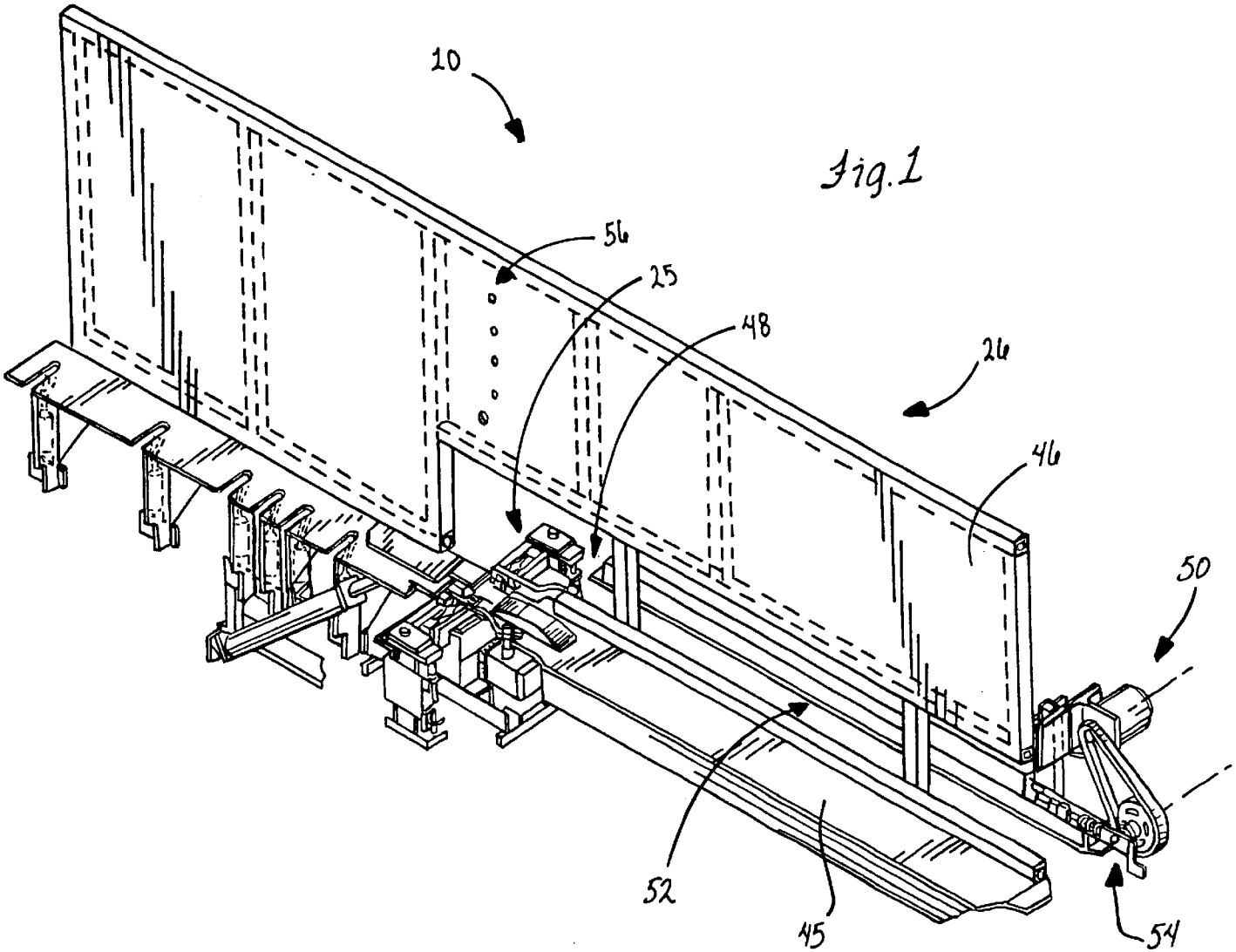
FIG. 1 is a perspective view of an apparatus for automatically applying clips to mattress spring assemblies in accordance with the present invention showing a frame including a ledge wall and a vertically inclined wall and an operating area of the apparatus.
Figure 2:
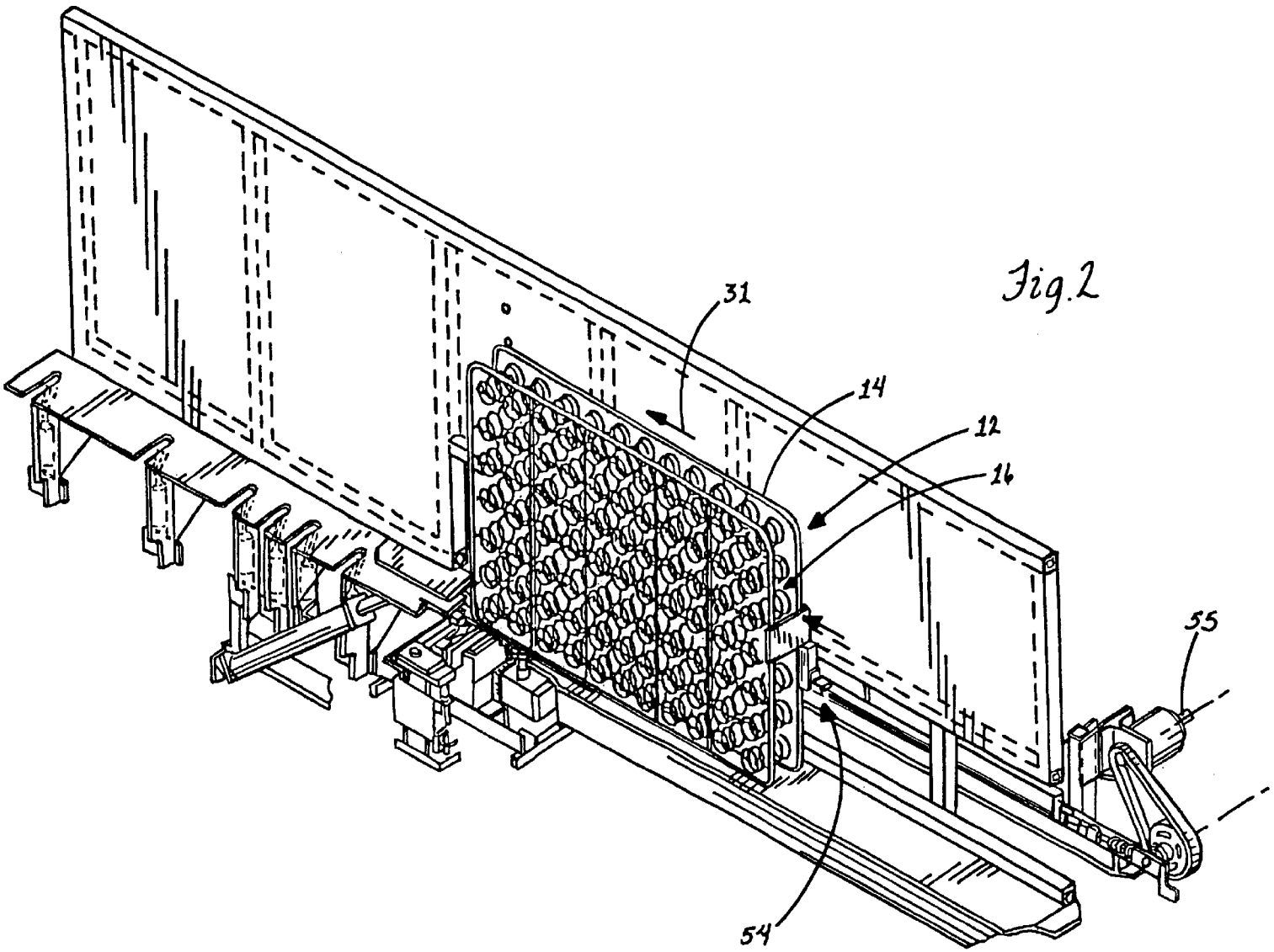
FIG. 2 is a perspective view of the apparatus of FIG. 1 showing a mattress spring assembly including borderwires and coils being advanced to the operating area for being clipped.
Figure 3:
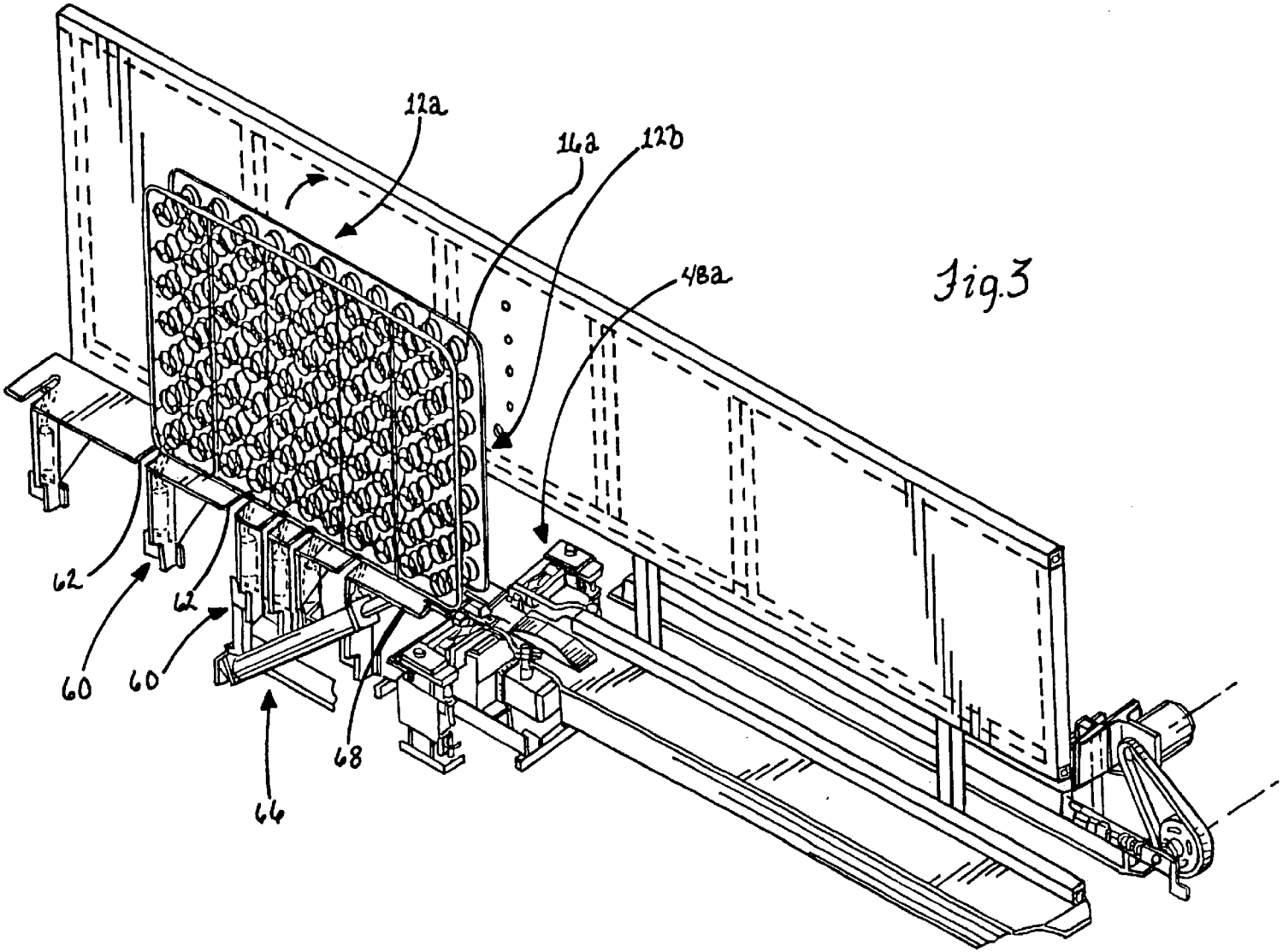
FIG. 3 is a perspective view similar to FIG. 2 showing the spring assembly advanced through the operating area to complete clipping of an entire side of coils to the borderwires.
Figure 4:
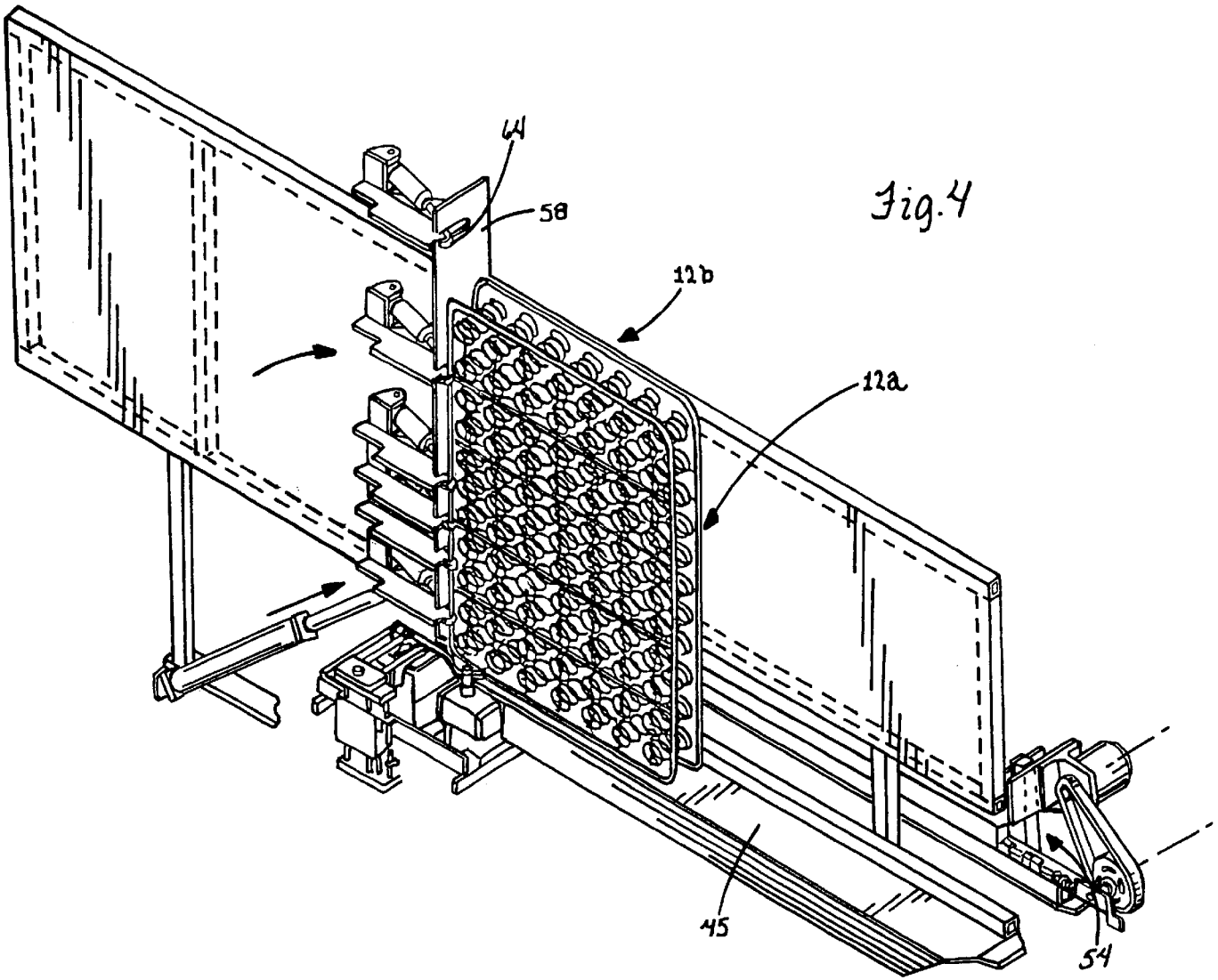
FIG. 4 is a perspective view of the apparatus of FIGS. 1–3 showing a rotating mechanism operable to orient the spring assembly for clipping of an end of the spring assembly adjacent to the previously-clipped side.
Figure 28:
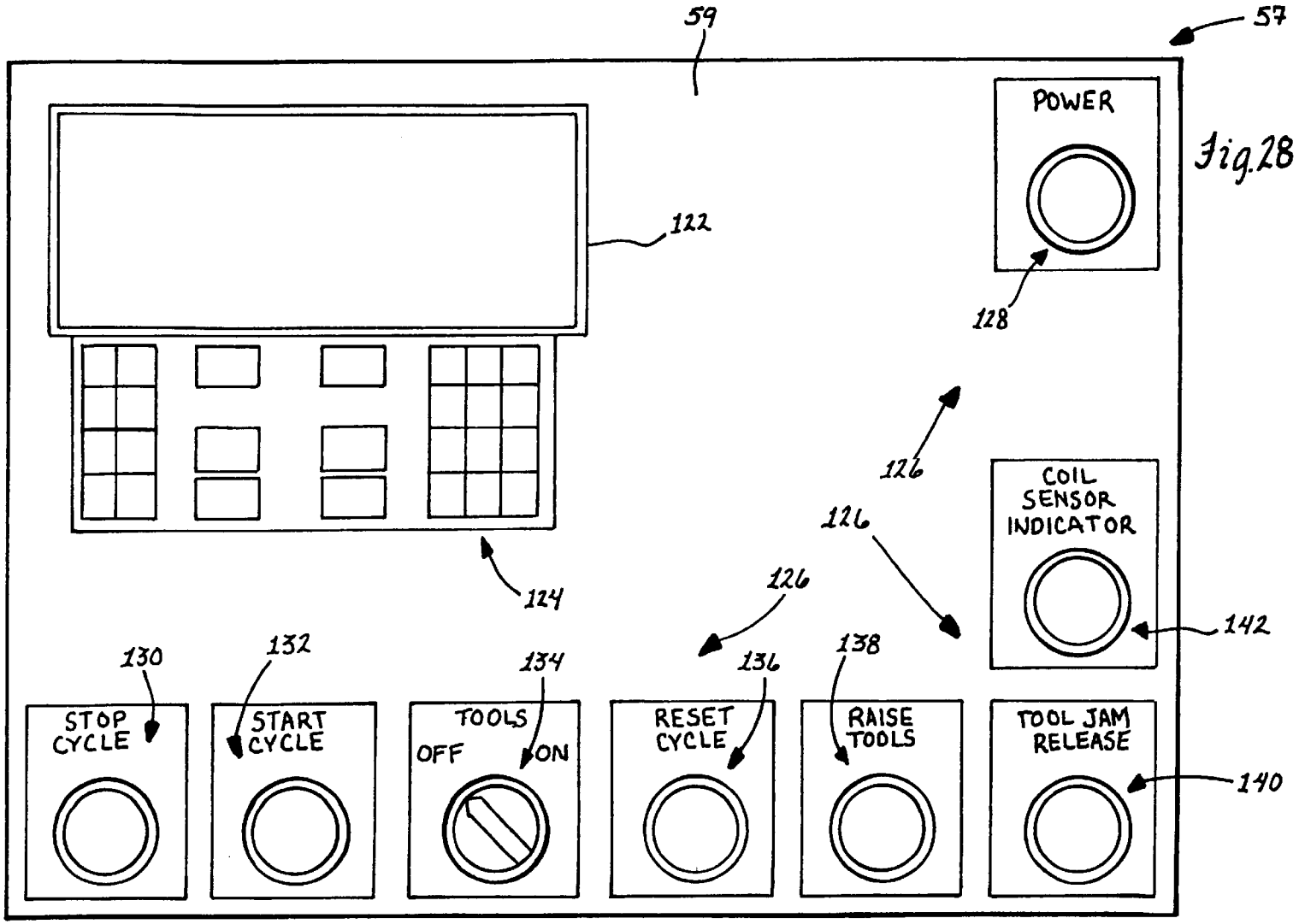
FIG. 28 is a view of the operator control panel interface to the controller for the present machine.

After an entire side 12*a* or end 12*b* of the perimeter spring coils 16 has been clipped to the borderwires 14, sensors (not shown) disposed behind a apertures 56 in the wall 46 at a position generally aligned with or slightly downstream from the clipping station 24 signal a controller 57 (shown by way of interface control panel 59 of the machine 10 in FIG. 28) of the clipping machine 10. Based on this signal, the controller 57 causes a pivotal paddle 58 to be activated for rotating the spring unit 12 onto the upstream side 12*a* or end 12*b* of the unit 12 to be clipped adjacent the side 12*a* or end 12*b* that has just been clipped. As is known, the paddle 58 is downstream of the lower support wall 45 substantially vertically aligned therewith so that after the unit 12 passes the clipping station 24, it is supported on the paddle 58, as can be seen in FIG. 3. Once the unit 12 has entirely passed the clipping station 24 along side 12*a* or end 12*b* thereof and is fully supported by the paddle 58, the sensor signal that indicates the unit 12 is to be rotated first causes gripper assemblies 60 located beneath slots 62 (see FIG. 23) in the paddle wall 58 to be activated so that gripping hooks 64 thereof extend through the associated slots 62 to hold the borderwire 14 spaced from the inclined wall 46 to keep the unit 12 securely against the paddle 58 and the wall 46 during the rotation thereof. With the hooks 64 holding the borderwire 14, a power cylinder 66 is actuated so that plunger member 68 is extended out from the cylinder 66 causing the pivotally mounted paddle 58 to pivot upwardly, as shown in FIG. 4. Pivoting of the paddle 58 causes the upstream adjacent side 12*a* or end 12*b* of the unit 12 to come to rest on the support wall 45 with the unit 12 in position for being advanced through the stations 22 and 24 for clipping coils 16 along the side 12*a* or end 12*b* of the unit 12 supported by the wall 45. Just prior to the rotation of the unit 12, the pusher assembly 54 is retracted back along its drive track 52 so as to reposition it for being advanced in the downstream direction 31 and pushing the unit 12 through the stations 22 and 24 in operating area 25 of the machine 10.

The positioning station 22 and clipping station 24 reside at downstream portion 48a of the space 48 formed between the support wall 45 and inclined wall 46 to allow for certain of the operating members 28 and the clip applicator tools 70 to be located on either side of the spring assembly unit 12 as it is driven downstream through the stations 22 and 24 along the lower support wall 45 and onto the paddle wall 58. Referring to FIGS. 5 and 7, the arm cam members 30 are in opposing relation with the lift member 38 affixed to the lower support wall 45 generally therebetween to form the positioning station 22. Similarly, the tools 70 are in opposing relation in that they are at the same position in the downstream direction 31. It is also contemplated that the tools 70 and the arms 30 could be offset in the direction 31 from each other without departing from the present invention.

Figure 19:
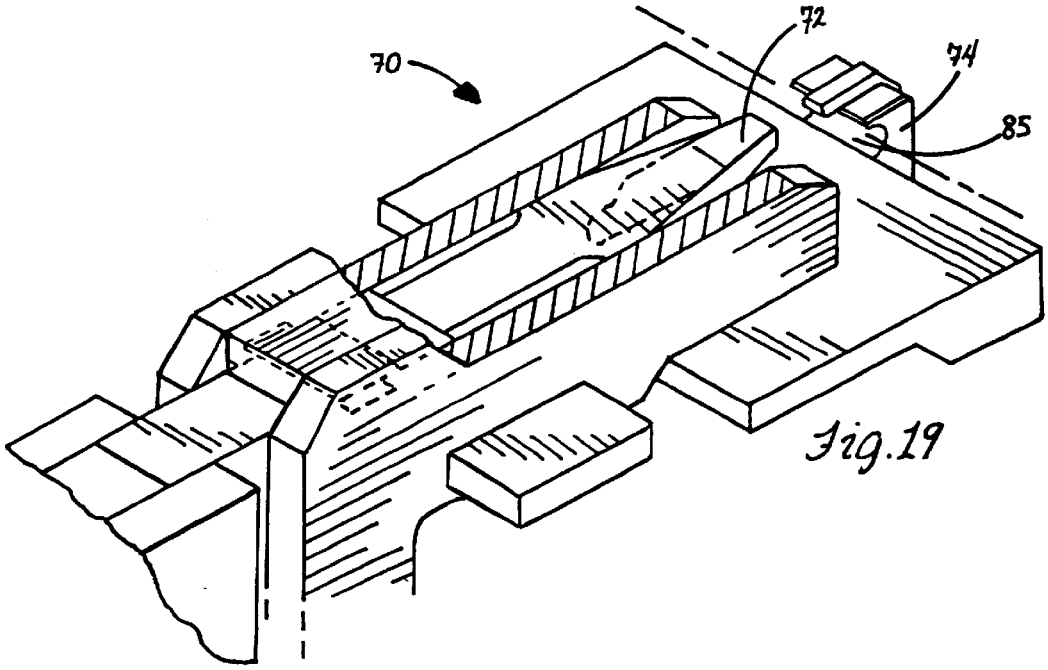
FIG. 19 is a partially broken away perspective view of one of the applicator tools showing an anvil surface and a jaw forming member of the tool.
Figure 20:
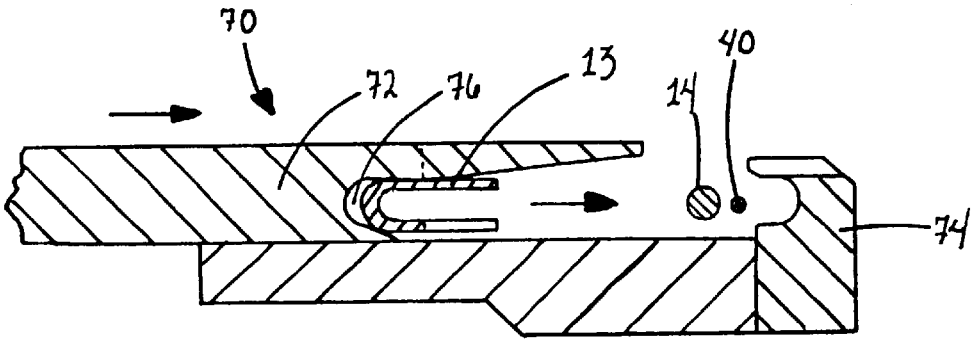
FIG. 20 is a cross-sectional view taken along line 20—20 of FIG. 7 showing the applicator tool with a clip disposed in a cavity of the forming member and the borderwire and an end coil of an innerspring in a predetermined clipping orientation adjacent the anvil.
Figure 21:
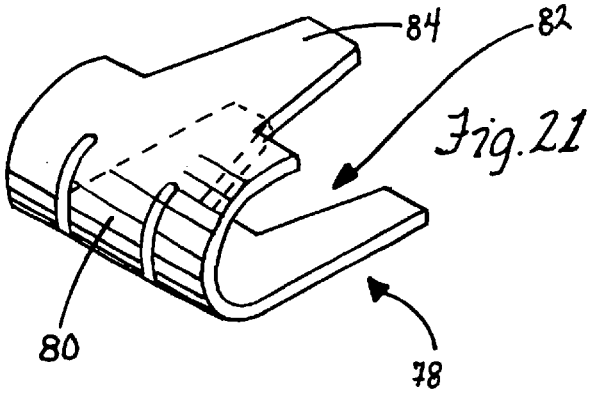
FIG. 21 is a perspective view of a clip that can be used for securing borderwires to the mattress coil springs.

The clip applicator tools 70 in the clipping station 24 each include a jaw or forming member 72 and an anvil 74, as can be seen in FIGS. 19 and 20. The forming member 72 includes a undercut cavity 76 in which the clips 13 are held. The clips 13 are generally U-shaped in profile with a pair of leg portions 78 that depend from arcuate crown portion 80, as can be seen in FIG. 21. One of the leg portions 78 is split to form space 82 aft therebetween while the other leg portion 78 has a central tongue 84 extending in alignment with space 82. The clips 13 are held in the jaw cavity 76 so that the leg portions 78 extend toward the anvil 74.

The anvil 74 includes a concave anvil surface 85. As the borderwires 14 and innersprings 16 reach the clipping station 24 the borderwires 14 and the bottoms 40 of the end coils 20 will be in their predetermined clipping orientation vis-a-vis the action the operating members 28 in the positioning station 22 such that the end coil bottoms 40 will be adjacent the concave anvil surface 85 with the borderwires 14 adjacent the end coil bottoms 40 and disposed outwardly relative thereto, as can be seen in FIG. 20.

A coil sensor 86 is provided slightly upstream of the tools 70 and is mounted at distal end of lever arm 88, as shown in FIG. 7. As the bottoms 40 of the innerspring coils 16 ride over the sensor 86, the lever arm 88 allows the sensor 86 to be depressed by pivoting thereof so that an electrical contact is made for signaling the controller 57 as to the presence of a coil spring 16. The sensor 86 is substantially as disclosed in U.S. Pat. No. 4,907,327, although it will be recognized other forms of coil sensors could also be effectively utilized.

The controller 57 is programmed to provide precisely coordinated operation of the various operating mechanisms of the apparatus 10 herein. In particular, once the controller 57 receives the initial signal from sensor 86 as a side 12*a* or end 12*b* of the spring assembly unit 12 begins to be advanced in the downstream direction 31 by the pusher assembly 54 of the machine drive 50, the controller 57 causes the arm members 30 to shift to their operative positions, as best seen in FIGS. 7, 14A, 14B, 18A and 18B. Further, the controller 57 can utilize a time delay that is based on the known drive speed of the pusher assembly 54 and distance between the applicator tools 70 and the sensor 86 to cause the applicator tools 70 to fire when the innersprings 16 are correctly positioned in the downstream direction 31 relative to the tools 70. Preferably, the controller 57 utilizes a distance measurement via position feedback signals it receives from the motor encoder 55 to determine when to fire the tools 70. At this time, the controller 57 causes the drive 50 to pause while the tools 70 fire.

Figure 22:
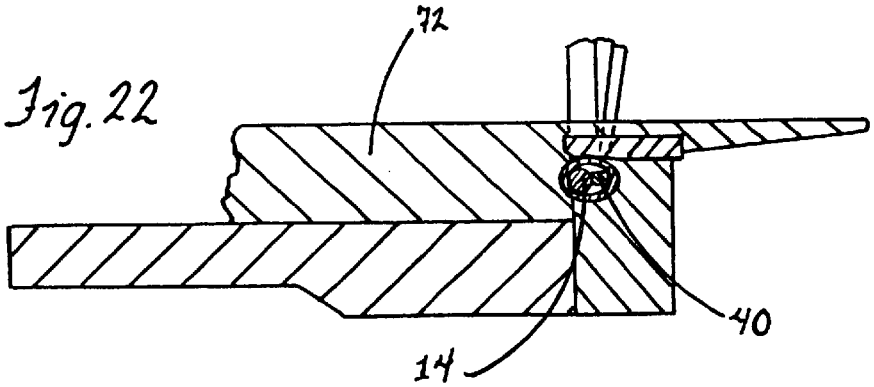
FIG. 22 is a sectional view showing the applicator tool fired with the forming member advanced to clench the clip about the borderwire and end turn of the mattress innerspring.
Figure 27:
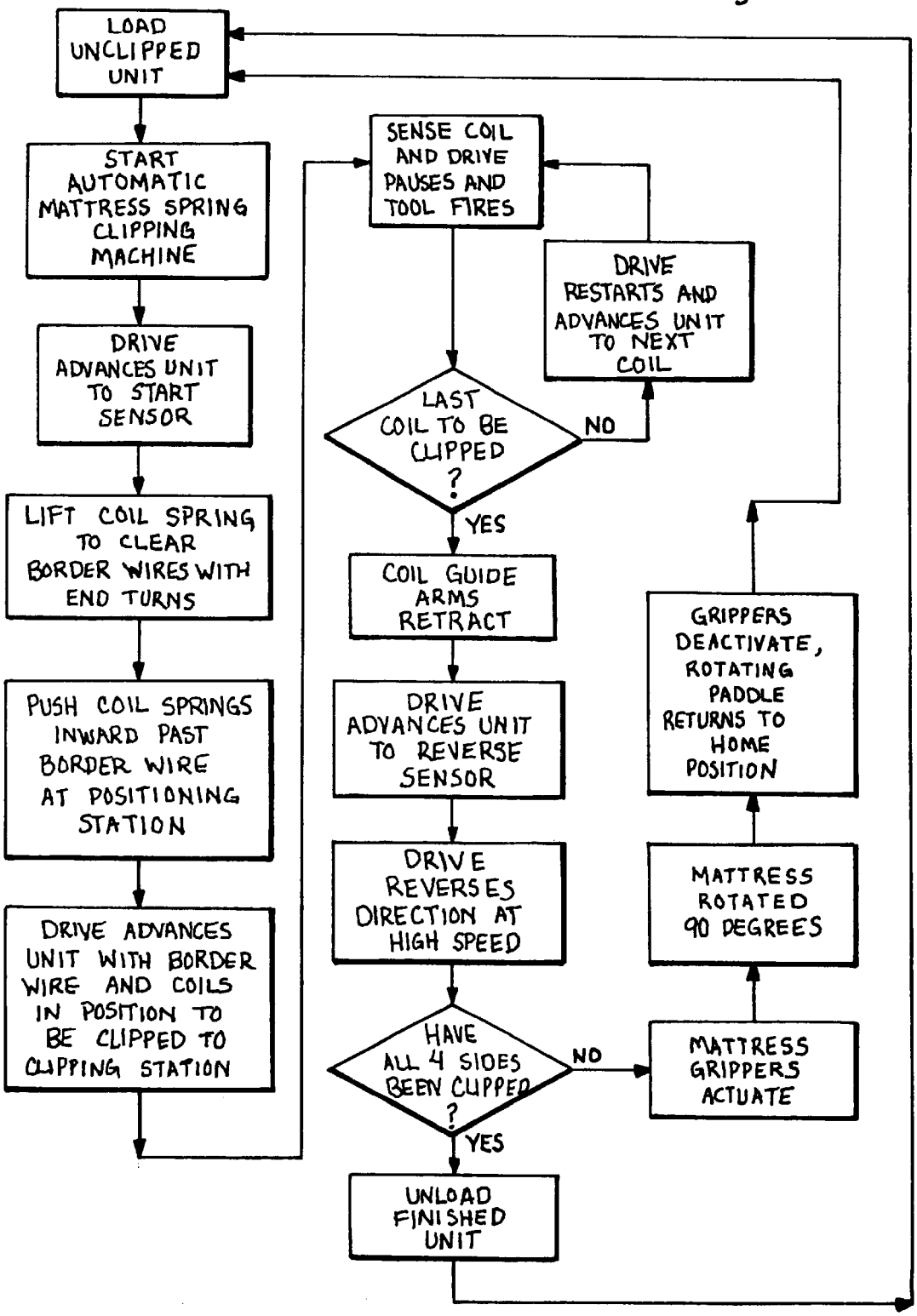
FIG. 27 is a flow chart of the method of operation of the apparatus of FIGS. 1–18 in accordance with the invention.

Referring to FIG. 22, when the tools 70 fire the jaw forming member 72 is extended toward the anvil 74 shifting the clip 13 and engaging and shifting first the outer borderwire 14 and then the inner, adjacent coil spring bottom in the crown portion 80 of the clip 13. Continued travel of the forming member 72 to the anvil 74 causes the leg portions 78 of the clip 13 to engage the concave anvil surface 85 for being clinched or wrapped about the borderwire 14 and bottom 40 of the coils 20. In this regard, the tongue 84 will slide around the upper portion of the anvil surface 85 and fit in the space 82 of the lower leg portions 78 as they slide up and around the lower portion of the anvil surface 85. Thereafter, the controller 57 causes the pausing drive 50 to restart to continue advancing the spring unit 12 in the downstream direction 31 until the next coil spring 16 is detected by the sensor 86. The controller 57 maintains the arm cam members 30 in their operative position until an entire side 12*a* or end 12*b* of coil springs 16 less the preclipped corner springs 16*a* thereof has been clipped to the borderwires 14. As previously discussed, this allows the present machine 10 to have increased rates of production of assembled spring units 12 as the arms 30 are not continuously being shifted between operative and inoperative positions for each clip 13 that is applied to the unit 12. FIG. 27 is a flow chart of the operation of the aforedescribed machine 10 from the time a spring assembly unit 12 is loaded into the machine 10 and until the perimeter coils 16 have all been clipped to the borderwires 14 about all sides 12*a* and ends 12*b* of the unit 12.

Figures 10, 11, 12:
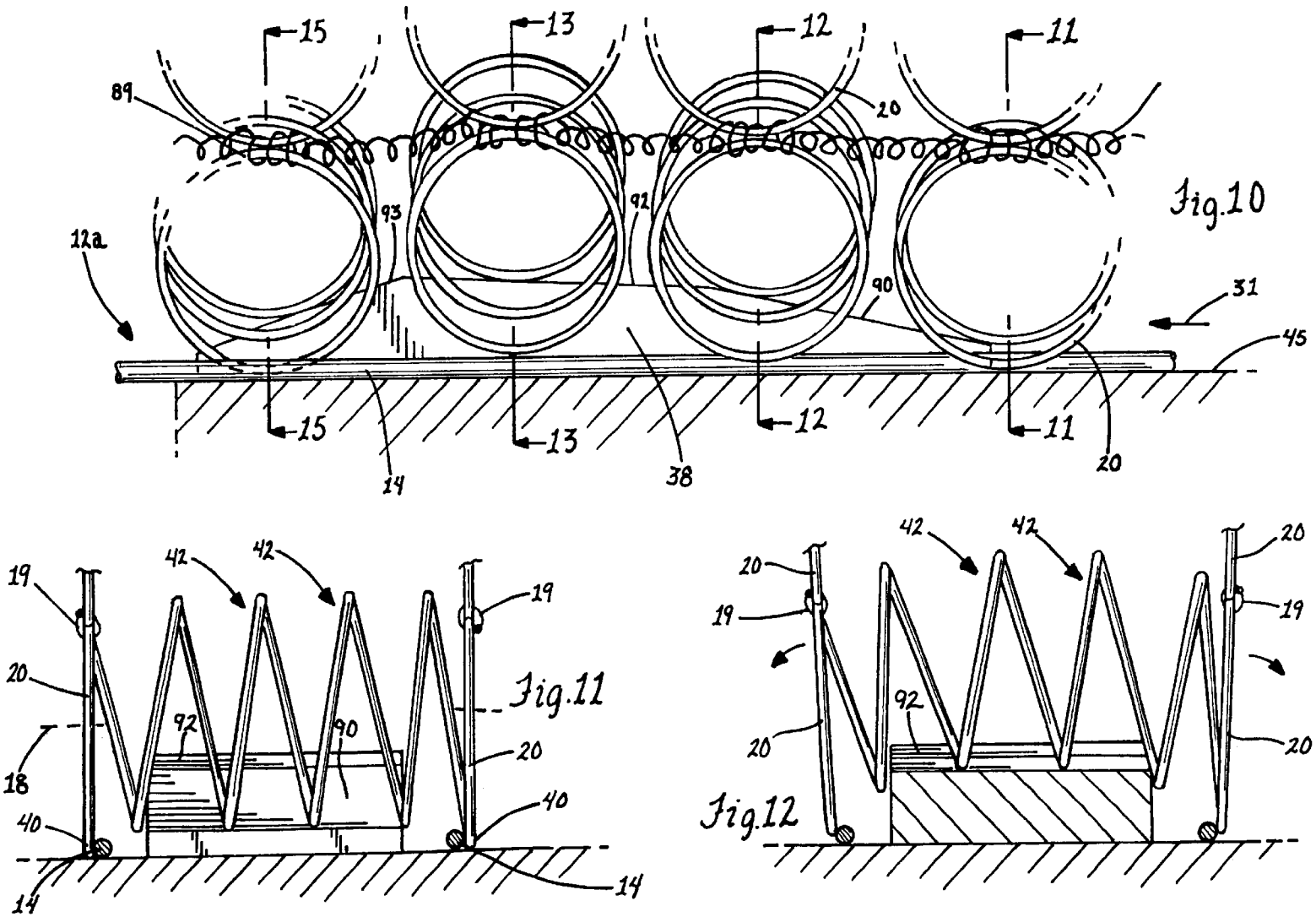
FIG. 10 is an elevational view of the innerspring coils riding on the lift member with a helical wire attaching the coils together and extending parallel to the travel direction of the spring assembly.
FIGS. 11–15 are cross-sectional views taken along corresponding lines of FIG. 10 to show the progression of the coils as they ride over the lift member.

FIGS. 10–18 will next be referenced for a more particular description of the action the positioning members 28 impart to the spring unit 12 as it is advanced through the positioning station 22 along either the side 12*a* or end 12*b* of the unit. In FIG. 10, the unit 12 has side 12*a* supported on ledge support wall 45. In the illustrated spring unit 12, the helical wires 19 run parallel to the sides 12*a* thereof such that in FIG. 10 the helical wires 19 are shown as wrapped around tops 89 of the perimeter coils 16 for connecting them to coils 16 in the upper adjacent coil row in the coil spring matrix.

The lift member 38 can have a block form and is affixed to the support wall 45 at the bottom thereof. The ramp 44 is formed on the upper surface of the lift block 38. As previously described, the ramp surface 44 extends at an upward incline in the downstream travel direction 31 so that as the unit 12 is advanced downstream, the innersprings 16 and specifically the intermediate coils 42 thereof are raised by engagement therewith. In the preferred and illustrated form as shown in FIG. 10, the ramp surface 44 has a leading section 90 that is at a sharper incline relative to a downstream trailing section 92 which has more of a gradual incline. It will be noted that the arm members 30 have been omitted from FIGS. 10–12 and 15 for clarity purposes to show the action of the lift block 38 on the coils 16.

Referring to FIG. 11, a coil spring 16 is shown just prior to its engagement with the lift block 38 where end coils 20 are disposed outwardly from the adjacent borderwires 14. FIG. 12 shows the next adjacent downstream coil 16 having reached the top of ramp surface section 90. Because the lift block 38 has a narrower transverse width than the length of the coil springs 16 along their axis 18, only intermediate turns 42 ride up the ramp surface 44. However, as the end turns 20 are connected to the intermediate turns 42, the lifting action imparted to the turns 42 will likewise cause some lifting of the end turns 20, as shown. Also, because the end turns 20 are attached to superimposed end turns 20 in the next adjacent, upper row of coil springs 16 via the helical wires 19, the lifting action imparted to the end coils 20 vis-a-vis intermediate coils 42 will cause a slight pivoting action of the end coils 20 about the helical wires 19 which, in at turn, causes a progressive inward canting of the coils 20 relative to the vertical, as can be seen in FIG. 12.

Figure 13:
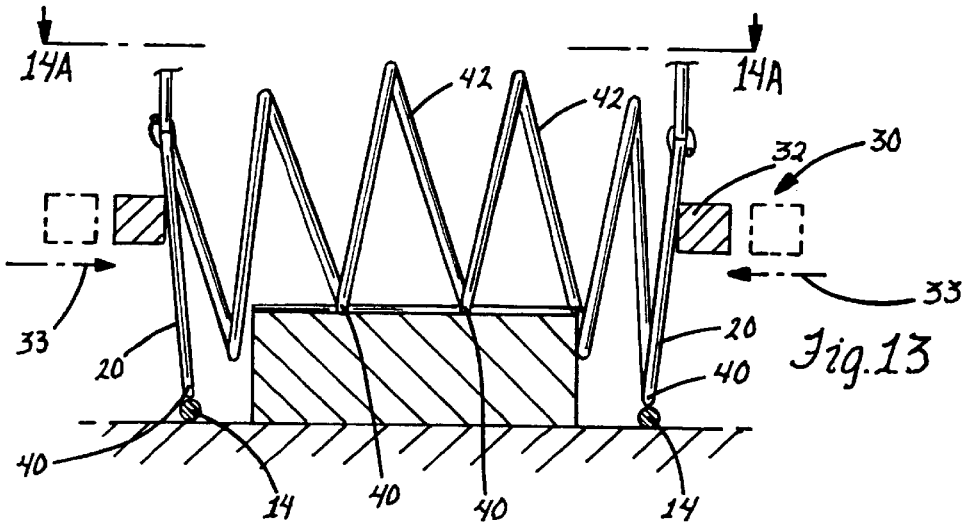
Figure 14A:
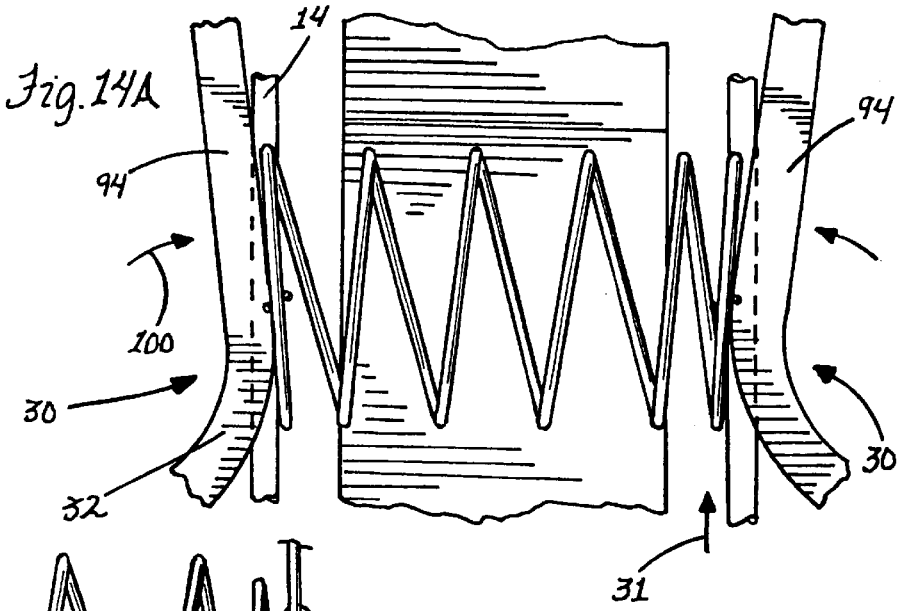

FIG. 13 shows the next adjacent downstream coil 16 riding on the trailing section 92 of the ramp surface 44 so that it is slightly raised with respect to the adjacent, downstream coil spring 16 of FIG. 12 as can be seen by a comparison of the position of the end coils 20 in FIGS. 12 and 13. The extra lift provided by ramp surface section 92 is sufficient to raise the bottoms 40 of the end turns 20 over the borderwires 14. In addition, the cam members 30 are shown schematically, and in particular, it can be seen that the cam portions 32 thereof come into play when the coils 16 reach the trailing surface section 92 of the ramp surface 44 with the cam members 30 in their operative positions. In this instance, the cam portions 32 can extend into the path of travel of the end coils 20 for engaging the end coils 20 intermediate the bottoms 40 and tops 89 thereof. As the cam portion 32 has an arcuate shape and extends in the transverse direction 33 relative to the downstream travel direction 31, engagement of the end coils 20 with the arcuate cam portion 32 causes the end coils 20 to be progressively pushed in the transverse direction 33 with continued downstream travel of the spring assembly unit 12.

In particular, the end coil engaging position of the arm cam portion 32 at an intermediate level along the height of the end coil 20 is desirable since the bottom 40 has already been drawn inwardly by the action of the lift member 38 raising the intermediate coils 42. In this regard, as the pushing action imparted by the arm cam portions 32 can occur with the end coils 20 lifted with their bottoms 40 clearing the borderwires 14 so that there is little interference from the borderwires 14 for shifting the end turns 20 to a position inwardly with respect thereto. The clearance provided by ramp member 38 is particularly desirable with respect to the end turns 20 and borderwire 14 that are generally aligned with the inclined wall 46. Because of the slight inclination of the unit 12 as supported by wall 46, the arm 30 aligned with the wall 46 will have to push the coil springs 16 slightly upwardly and thus have to overcome greater resistance to coil shifting than the opposed arm 30 which pushes the coils 16 on a slight downward incline. By providing clearance between the end turns 20 and the borderwires 14, the lift member 38 makes it easier for the arm 30 that has to push the coil springs 16 slightly upward to do so without encountering additional resistance from the adjacent borderwire 14. It has been found that the coordinated action provided by the cam members 30 and the lift member 38 for shifting the end turns 20 to an inward disposition relative to the borderwires 14 is advantageous in terms of obtaining the desired predetermined clipping orientation therebetween in a reliable, repeatable manner and at high rates of throughput for the present machine 10.

Figure 15:
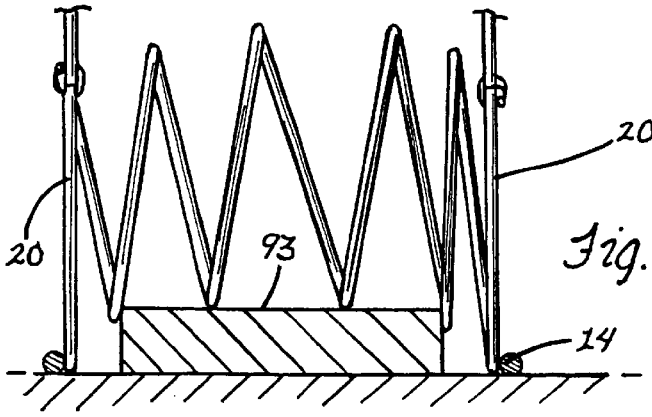
Figure 14B:
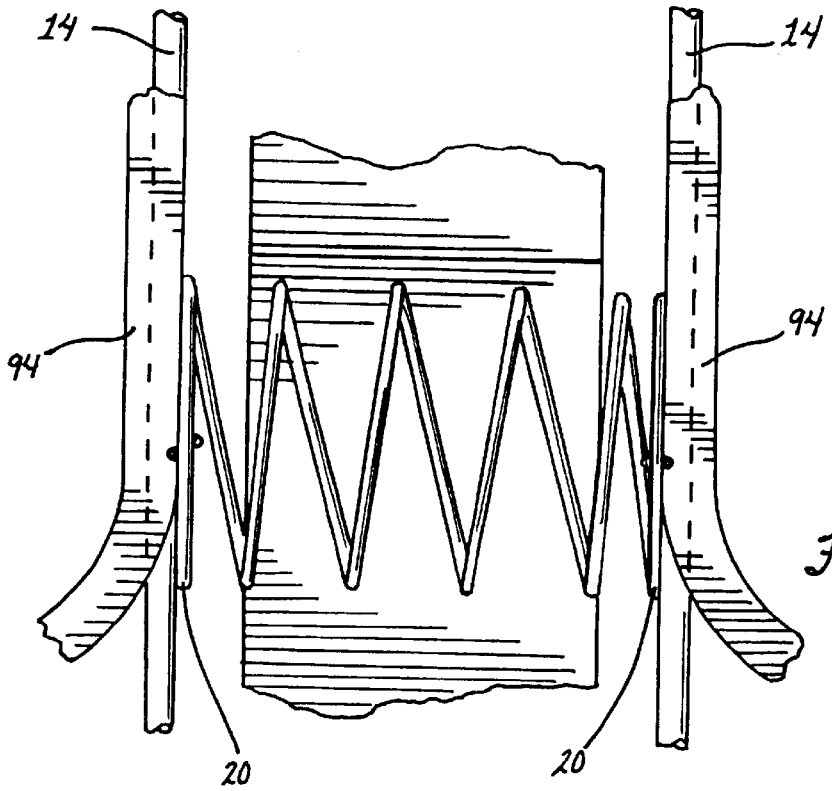

FIG. 15 depicts the position of the coils 16 at the downstream end of the lift block 38 in FIG. 10. To this end, the lift member 38 preferably has a down ramp section 93 along which the intermediate coils 42 ride. The down ramp 93 is at a downward incline in the downstream direction 31 so that as the coil springs 16 ride thereover, the end coils 20 thereof are lowered after having been progressively lifted and drawn toward each other by the lift member 38 and pushed inwardly by the cam members 30 so that they are in the desired predetermined clipping orientation relative to the borderwires 14, as shown in FIG. 15.

To ensure that the end coils 20 and borderwires 14 maintain their predetermined clipping orientation until they reach the clipping station 24, the cam members 30 are preferably provided with a guide portion 94 downstream of the cam portion 32. The guide portions 94 preferably have a straight elongate form and are integral with the cam portion 32. In this regard, the guide portions 94 extend from upstream in the clipping station 24 downstream to a terminal end 96 thereof which is disposed in alignment with the clipping station 24 generally above the applicator tools 70 therein. Accordingly, with the cam members 30 fully pivoted to their operative positions, the elongate guide portions 94 of the cam members 30 will generally extend in the downstream direction 31 above the borderwires 14 for maintaining the end coils 20 pushed past the borderwires 14 in their predetermined clipping orientation until they reach the clipping tools 70 at which point the clips 13 can be properly applied thereto.

Figure 18B:
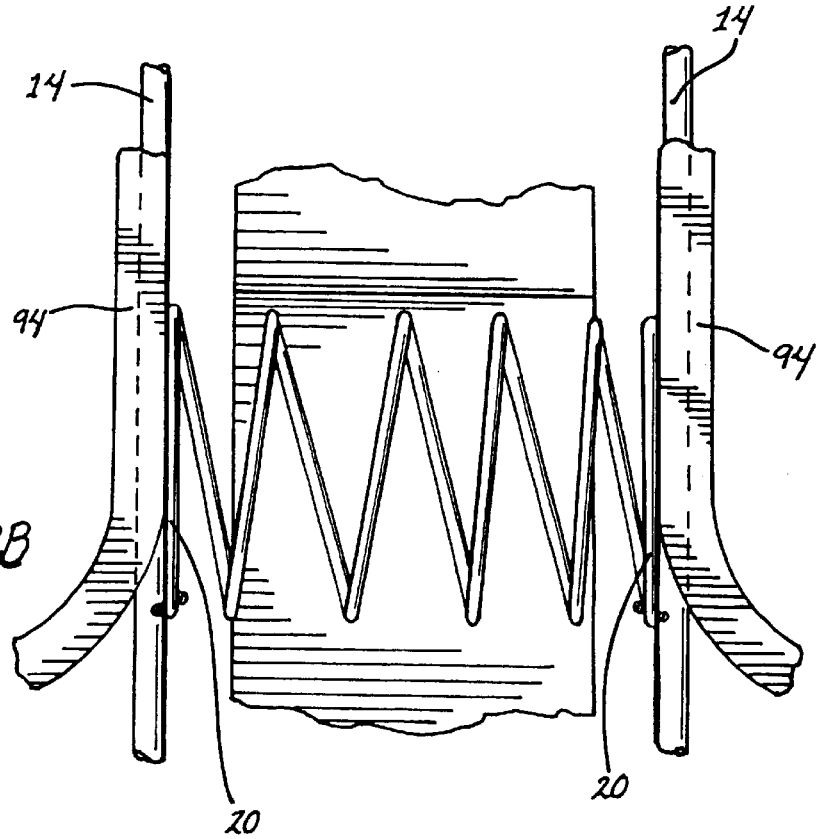
FIG. 18B is a plan view similar to FIG. 18A with the arms fully shifted to their operative position and guide portions of the arms extending in the downstream direction for guiding the end turns shifted to the predetermined clipping orientation.
Figure 16:
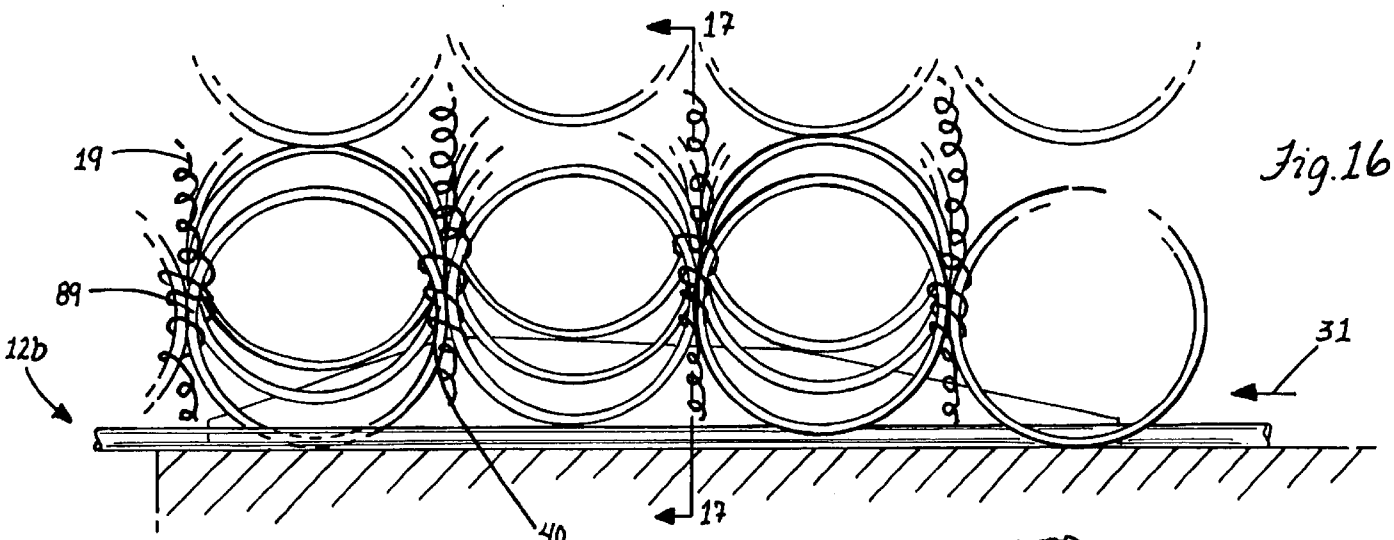
FIG. 16 is an elevational view of the coils riding on the lift member similar to FIG. 10 but with the helical wires extending normal to the travel direction as the spring assembly has been rotated by 90° degrees from the FIG. 10 orientation after an entire side or end thereof has been clipped for clipping the next adjacent side or end.
Figure 18A:
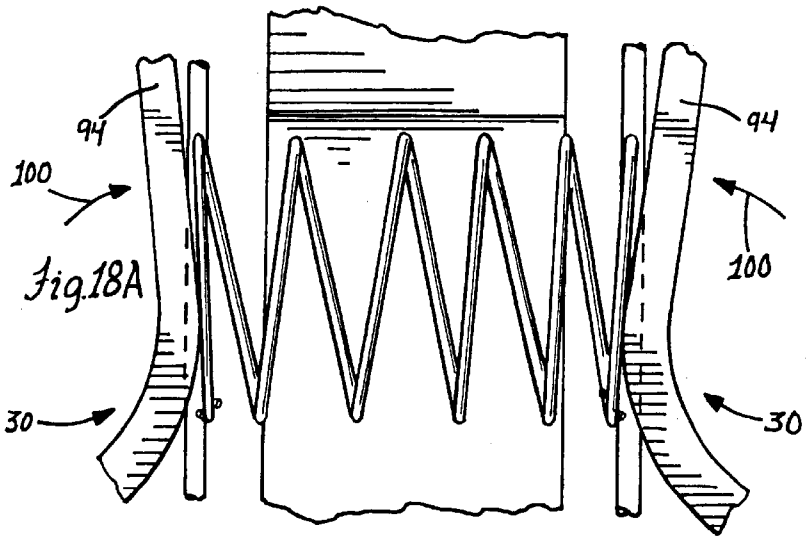
FIG. 18A is a plan view taken along line 18A—18A of FIG. 17 showing the arms being shifted to their operative position with the arm cam portions engaging the end turns as the associated coil rides on the lift member to push the end turns transverse to the spring assembly travel direction.
Figure 17:
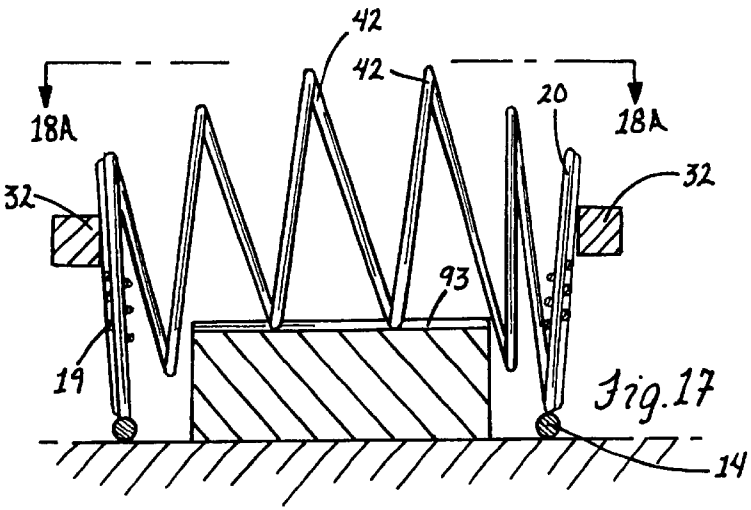
FIG. 17 is a view taken along line 17—17 of FIG. 16 showing the end turns canted inward.

FIGS. 16–18 are similar to the just described FIGS. 10–15 except the spring unit 12 is now oriented on its end 12*b* for clipping the perimeter coil springs 16 thereat to the end portion of the borderwires 14. In this orientation, the bottoms 40 and tops 89 of the coils will now be oriented as sides thereof with the helical wires 19 running in a normal direction to the downstream travel direction 31. Accordingly, as the innersprings 16 ride up the ramp 44, the cant provided to the end coils 20 is slightly different due to the vertical orientation of the helical wires 19. Regardless, the lifting action provided by the member 38 on the intermediate coils 42 is still sufficient to lift the end coils 20 for clearing the borderwires 14 and allowing the arm cam portions 42 to push the end coils 20 in the transverse direction 33 without encountering significant interference from the borderwires 14. With the cam members 30 in their operative positions as shown in FIG. 18B, the guide portions 94 maintain the end coils 20 in the predetermined clipping orientation relative to the borderwires 14 as shown until they reach the applicator tools 70.

At the beginning of the clipping process for each side 12*a* or end 12*b* of the spring assembly units 12, the controller 57 causes the cam members 30 to shift from their inoperative positions to their operative positions, as previously described. In the preferred and illustrated form, actuators in the form of cylinders 98 mount the cam members 30 for pivoting to their operative positions, as indicated by arrows 100 in FIGS. 7, 14A and 18A. It is noted that the spring assembly unit 12 initially may be disposed such that some of its coil springs 16 including those that may not be preclipped along a side 12*a* or end 12*b* thereof are located downstream of the lift block ramp surface 44 prior to shifting of the arm members 30 to their operative positions such as when the paddle 58 rotates the unit 12. In this instance, the coil on the down ramp 94 will still be lifted to a certain degree relative to the ledge wall 45 and borderwires 14 supported thereon but possibly not in a clearance condition therewith. However, it has been found that the pivoting force imparted to the cam arms 30 by the cylinder 98 is sufficient to cause the guide portions 94 to pivotally engage and push the end coils 20 against and past the borderwires 14 into the predetermined clipping orientation, if such action is necessary.

Turning to more of the details of the present machine 10 and referring to FIGS. 5 and 6, the applicator tools 70 are mounted to a level adjust mechanism 102 which allows for the vertical level of the tools 70 to be changed such as for different types of coil springs 16 that may be employed in a spring assembly 12. The level adjust mechanism 102 can include a cylinder 104 mounted for sliding to three different predetermined positions on rods 106. The positions can be defined by limit or proximity switches 108, as shown. For adjusting the tools 70, slot openings 110 can be provided in which a securing device 112 can fix the cylinder body in any one of the predetermined positions. Fine tuning of the position of the tools 70 can be accomplished by a threaded fastener 114 extending through an internally threaded through opening 116 in top plate 118 fixed at the upper ends of the guide rods 106. The bottom end of the fastener 114 abuts against stop 120 disposed on top of the cylinder body 104 so that turning the fastener 114 can fine tune the position of the cylinder 104.

FIG. 28 shows a control panel 59 which allows for operator interface with the controller 57. As shown, the control panel 59 includes a display screen 122 with a keypad input 124. Various controls, generally designated 126, are also provided to allow the operator to more effectively control machine operation from the panel 59 remote from the machine 10. Accordingly, the controls include a "POWER" button 128 for providing power to the drive 50 and various actuators of the operating mechanisms of the machine 10. "STOP CYCLE" and "START CYCLE" buttons 130 and 132 provide a controlled stopping and starting of the machine cycle. The machine can be cycled with the tools 70 "ON" or "OFF" as provided by selector switch 134 such as to check clipping position or setup. The machine cycle can be reset by control button 136. For adjusting the tools 70 by the previously described level adjust mechanisms 102, control button 138 is provided. If a problem occurs upon firing of the tools 70 pressing button 140 causes the tools 70, to retract. Finally, control button 142 allows an indicator to be activated if the operator desires to have a visual indication of coil spring detection by sensor 86.

FIGS. 23–26 depict an alternate form of a machine 10*a* in accordance with the invention herein. In this form, the positioning station 22 includes the previously-mentioned restraining mechanism 36 in place of the aforedescribed lifting mechanism 34 and in conjunction with the pushing mechanism 29. In all other respects, the machine 10*a* is substantially the same as the previously described machine 10 and thus their common features will not be discussed further herein.

The operating members 28 of the machine 10*a* include the arm members 30 and finger members 144 of the restraining mechanism 36. The finger members 144 each have a restraining portion 146. With the fingers 144 in their operative position, the portions 146 will be disposed inwardly of the borderwires 14 to restrain the borderwires from shifting in the transverse or axial direction 33 as the end turns 20 of the coil springs 16 are being pushed inwardly against and past the restrained borderwires 14 by the cam members 30. The fingers 144 do not act to deform the borderwires 14 in any fashion; instead, the restraining portions 146 only keep the wires 14 in a fixed transverse position so that they are not shifted inwardly as the arms 30 engage and progressively push the coil spring end turns 20 against and past the borderwires 14.

More particularly, the fingers 144 each include an actuator in the form of power cylinder 148 having a plunger 150 connected at its distal end to lower portion 152 of the finger member 144. The finger member 144 is pivotally mounted at 154 and the cylinder 148 can also be pivotally mounted at its lower end at 156. Upper portion 158 of the finger members 144 includes the restraining portion 146 which can have a hook shape to define recess 160.

Figure 26:
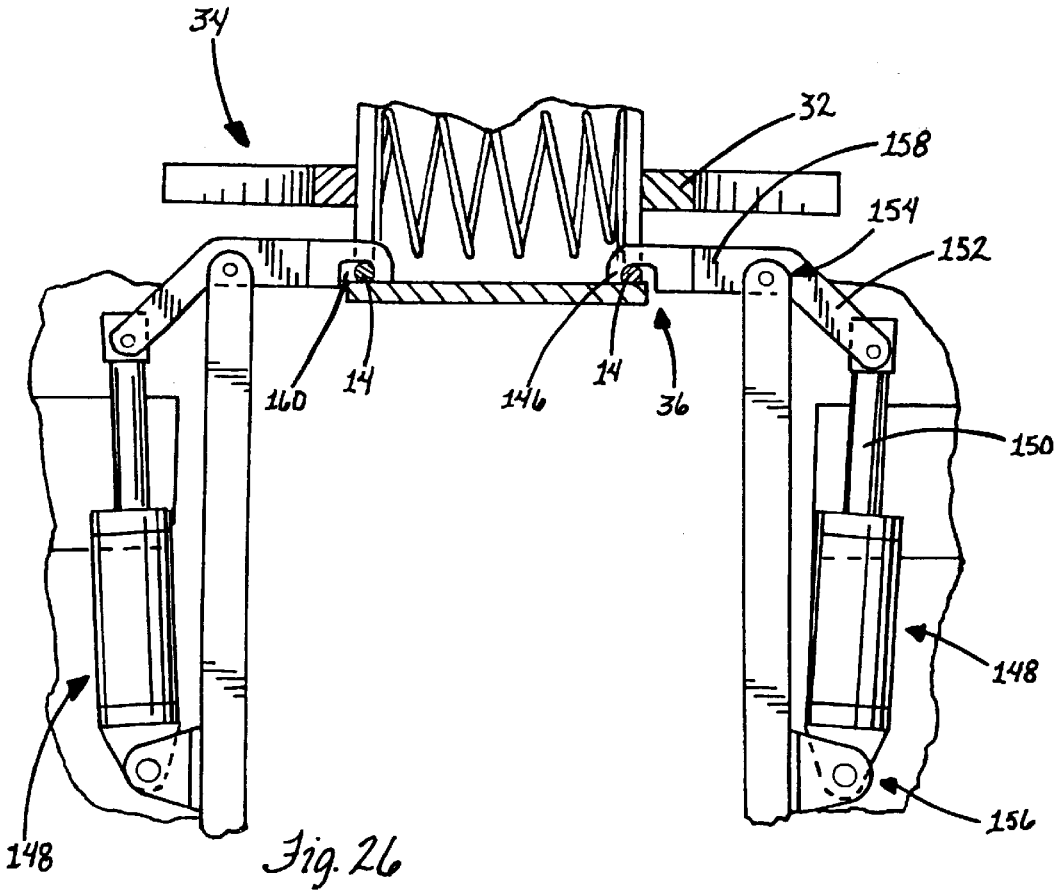
FIG. 26 is a view partially in section taken along line 26—26 of FIG. 25 showing the arm and finger members in the positioning station with restraining portions of the finger members operable to keep the borderwires from shifting transversely.
Figure 23:
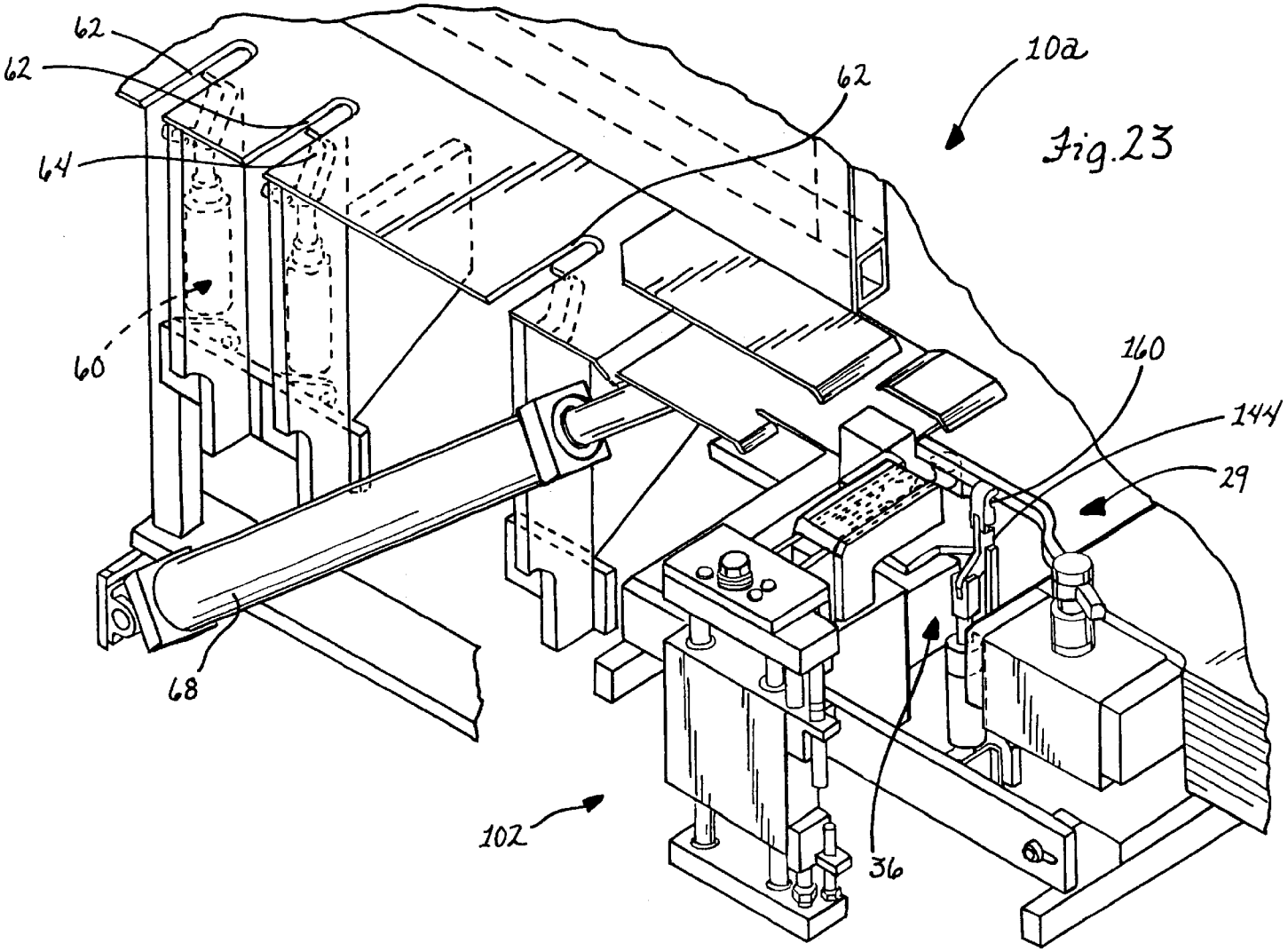
FIG. 23 is a view similar to FIG. 5 showing an alternative embodiment of an automatic clipping apparatus in accordance with the present invention.
Figure 24:
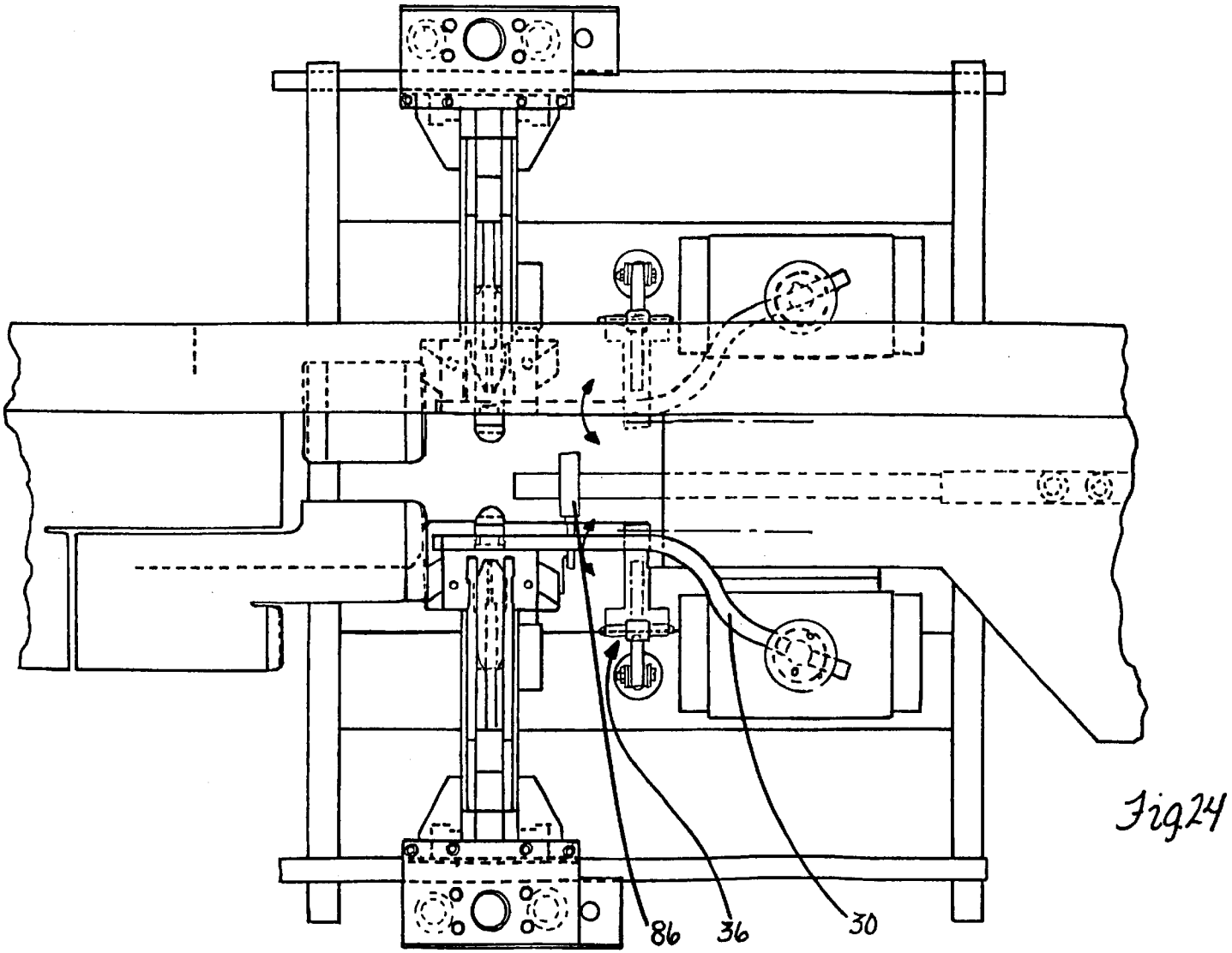
FIG. 24 is a plan view of the operating area of the alternative apparatus showing arm members including arcuate portions thereof pivoted to their operative position and finger members for restraining the borderwires.
Figure 25:
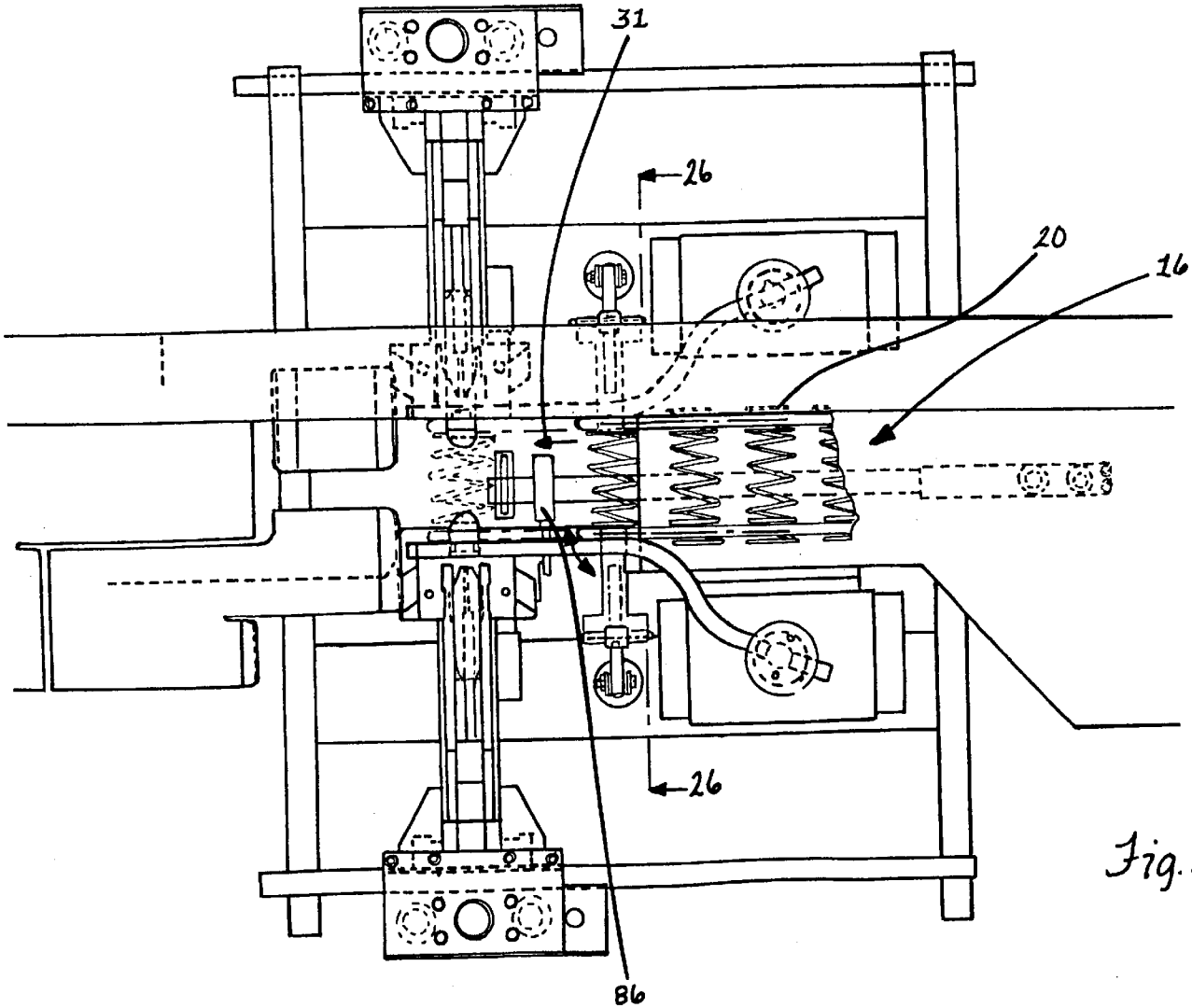
FIG. 25 is a plan view similar to FIG. 24 showing a spring assembly advancing through the operating area with the arm arcuate portions pushing the ends of the coils past the borderwires and the fingers guiding the borderwires through the positioning station.
Figure 29:
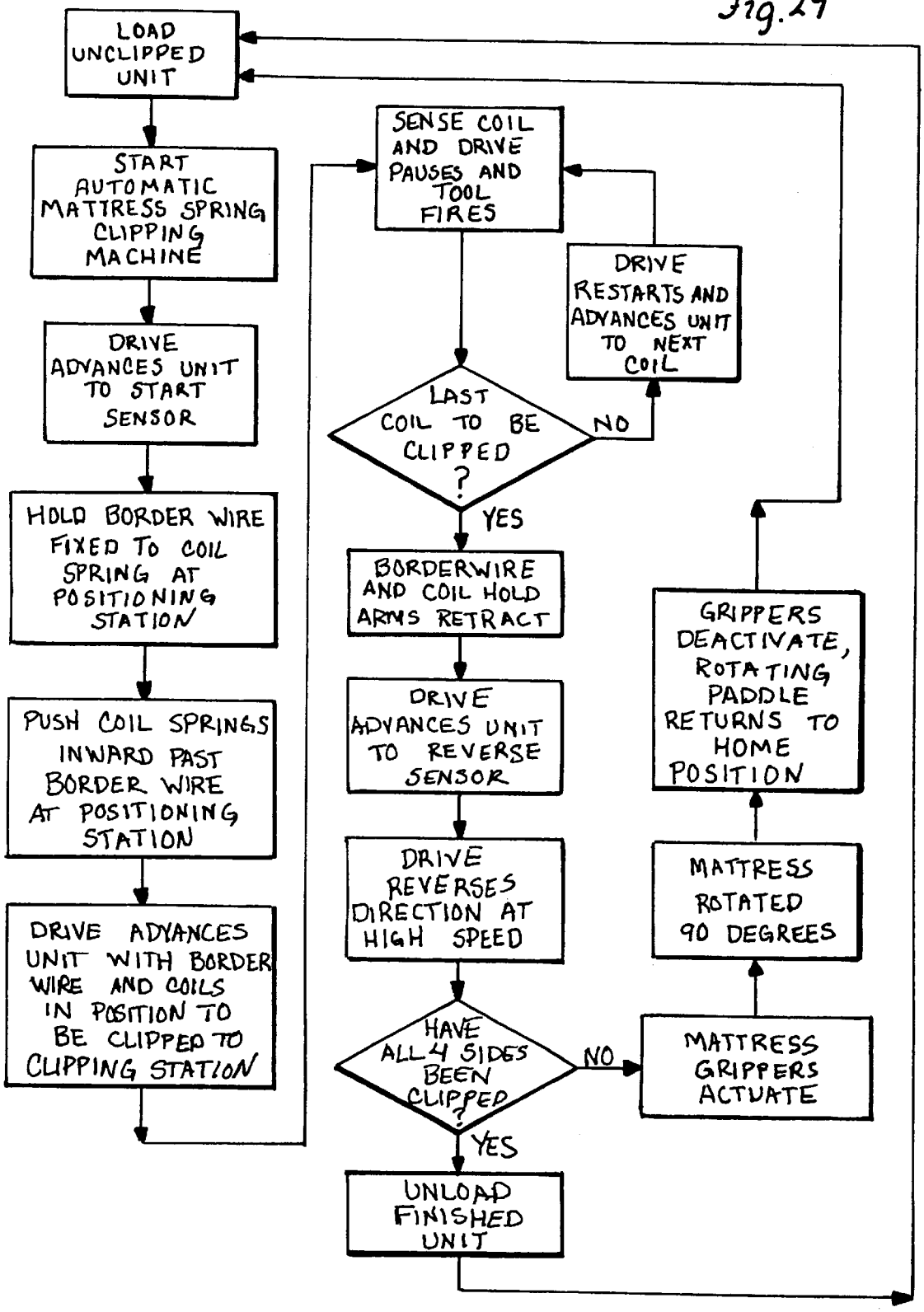
FIG. 29 is a flow chart of the method of operation of the apparatus of FIGS. 23–26 in accordance with the present invention.

As can be seen in FIG. 23, in the inoperative position of the finger members 144, the upper portion 158 extends substantially vertical with the recess 160 facing inwardly. Once the sensor 86 detects the innersprings 16, the controller 57 causes the actuator cylinders 98 and 148 for the cam members 30 and finger members 144, respectively, to fire to shift the members 30 and 144 to the operative positions thereof. In this regard, the plunger 150 is extended from the cylinder 148 causing pivoting of the restraining mechanism 36 about pivots 154 and 156, as shown in FIG. 26. The pivoting of finger members 144 about pivot 154 causes the upper portion 158 to pivot downwardly with the end of the hook shaped restraining portion 146 disposed inwardly of the borderwires 14 and the recess 160 now facing downwardly. The fingers 144 provide a channel through which the borderwires 14 travel downstream with the hook portion 146 keeping the borderwires 14 fixed in the transverse direction 33 against shifting inward by the previously-described urging of the coil spring end turns 20 inwardly against and past the borderwires 14 by the cam members 30. Similar to the cam members 30, the finger members 144 stay actuated during clipping of the unclipped perimeter coils 16 along an entire side 12*a* or end 12*b* of a unit 12 so that the operating members 28 of the machine 10*a* do not slow production by repeated cycling thereof during this process. FIG. 29 is a flow chart depicting the clipping process for an entire spring assembly unit 12 using the above-described alternative machine 10*a* including the borderwire restraining mechanism 34.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. An apparatus for automatically applying clips to mattress spring assemblies including borderwires extending about mattress innersprings, the apparatus comprising:

a frame including portions for supporting spring assemblies in a generally vertical orientation;

a drive mechanism which advances spring assemblies in their vertical orientation in a downstream travel direction along the frame portions for being clipped;

a clipping tool for securing clips about borderwires and innersprings for clipping the spring assembly together; and at least one positioning member upstream from the clipping tool which engages and shifts the innersprings past the borderwires in a direction transverse to the downstream direction as the spring assembly is traveling in said downstream travel direction.

2. The apparatus of claim 1 wherein the at least one positioning member comprises an arm member having an arcuate portion thereof for progressively urging the innersprings past the borderwires in the transverse direction as the spring assembly travels in the downstream direction.

3. The apparatus of claim 1 wherein the at least one positioning member comprises a lift member having a ramp surface extending at an upward incline in the downstream direction.

4. The apparatus of claim 1 wherein the at least one positioning member comprises a lift member and an arm member which cooperate to shift the innersprings past the borderwires in the transverse direction as the spring assembly travels in the downstream direction.

5. In an apparatus which automatically applies clips to mattress spring assemblies in a clipping station with the mattress spring assemblies including borderwires extending about mattress innersprings and being secured in a predetermined clipping orientation thereto, a pushing mechanism comprising:

a first portion of the pushing mechanism upstream from the clipping station for engaging innersprings that are not in the predetermined clipping orientation relative to the borderwires as the mattress spring assembly is advanced in a downstream direction toward the clipping station, the first portion extending in a direction transverse to the downstream direction to push the innersprings past the borderwires in the transverse direction for positioning the innersprings in the predetermined clipping orientation as the spring assembly is traveling in the downstream direction; and a second portion of the pushing mechanism extending from upstream of the clipping station and having an end thereof in the clipping station to keep the innersprings in the predetermined clipping orientation during downstream travel of the spring assembly to the clipping station.

6. The pushing mechanism of claim 5 wherein the first and second portions are integral with each other.

7. The pushing mechanism of claim 6 wherein the apparatus includes a frame supporting the spring assembly in a substantially vertical orientation and clipping tools of the clipping station that are disposed at either side of the spring assembly supported by the frame during downstream travel thereof, and a pair of said first and second portions with a first one of the pair provided on one side of the spring assembly and a second one of the pair provided on the other side of the spring assembly.

8. The pushing mechanism of claim 7 wherein the pair of first and second portions are aligned across from each other for compressing the innersprings in engagement therewith.

9. The pushing mechanism of claim 7 wherein the ends of the second portions are disposed above the clipping tools.

10. The pushing mechanism of claim 5 wherein the first portion has an arcuate shape for camming the innersprings in the transverse direction as the spring assembly is traveling in the downstream direction.

11. The pushing mechanism of claim 5 wherein the first portion is bowed inward opposite to the downstream travel direction of the spring assembly.

12. The pushing mechanism of claim 5 in combination with a lifter mechanism for raising the innersprings to clear the borderwires to allow the first portion to push the innersprings in the transverse direction substantially without encountering interference from the borderwires.

13. The pushing mechanism of claim 5 in combination with a restraining mechanism for keeping the borderwire in a substantially fixed transverse position as the first portion pushes the innersprings in the transverse direction against and past the borderwires.

14. An apparatus for automatically clipping borderwires to springs of mattress spring assemblies which have sides and ends thereof with corners therebetween at which the borderwires are preclipped to end coils of the innersprings thereat, the apparatus comprising:

a frame including portions for supporting spring assemblies in a generally vertical orientation in a path of travel therealong;

a drive mechanism which advances the spring assemblies in their vertical orientation in a downstream travel direction along the frame for being clipped with the innersprings having an axis generally extending in a direction transverse to the downstream direction;

applicator tools for securing clips about borderwires at either end coil of the innersprings with the borderwires and end coils being positioned in a predetermined clipping orientation as they are advanced by the drive mechanism to the tools;

a lift member having a ramp surface upwardly inclined in the downstream direction for raising the innersprings so that the end coils clear the borderwires;

arm members having cam portions so that with the arm members in operative positions the cam portions progressively urge engaged end coils of the innersprings axially toward each other as the spring assembly is advanced in the downstream direction for cooperating with the lift member to shift the end coils toward the predetermined clipping orientation;

a controller which keeps the arm members in their operative positions without shifting to inoperative positions thereof as the spring assembly is advanced through the clipping station and clips are applied to the unclipped innersprings along an entire side or end of the spring assembly.

15. The apparatus of claim 14 wherein the arms are mounted for pivotal movement and the cam portions are arcuate portions of the arms, the arms being pivoted to the operative positions with the arcuate portions extending into the path of travel of the spring assembly and transverse to the travel direction so that the arcuate portions cammingly engage the end coils of the innersprings to progressively urge the end coils toward each other as the spring assembly is continuing travel in the downstream direction.

16. The apparatus of claim 15 wherein the arms include guide portions downstream of the arcuate portions for maintaining the predetermined clipping orientation between the end coils and border wires during downstream travel to the applicator tools.

17. The apparatus of claim 14 including a sensor for detecting the spring assembly and sending a signal to the controller for operating the applicator tools and the arm members, the controller upon receiving the signal causes the arm members to shift to their operative positions, the drive mechanism to pause with the borderwires and innersprings in the predetermined clipping orientation at the clipping station, the applicator tools to fire with the arm members maintained in their operative positions, and the drive mechanism to restart to continue advancing the spring assembly downstream.

18. The apparatus of claim 14 wherein the arm members include straight portions generally extending in the travel direction and disposed downstream of the cam portions of the arm members with the arm members in their operative positions to maintain end turns in the predetermined clipping orientation.

19. An apparatus for automatically applying clips to mattress spring assemblies including borderwires extending about ends of mattress innersprings, the apparatus comprising:

a frame including portions for supporting spring assemblies in a generally vertical orientation to be advanced in a downstream travel path;

a drive mechanism which advances spring assemblies in their vertical orientation in a downstream travel direction in the travel path along the frame for being clipped;

a clipping station including at least one applicator tool for securing clips about borderwires and innerspring ends for clipping the spring assembly together; and a lifting mechanism that is affixed to the frame in the travel path upstream of the clipping station and which is configured for raising portions of the innerspring intermediate the ends thereof to shift the ends past the borderwires in a direction transverse to the downstream direction.

20. The apparatus of claim 19 wherein the lifting mechanism comprises a ramp surface that extends at an incline upwardly in the downstream direction so that the innerspring portions are raised as an incident of the downstream travel of the spring assembly.

21. The apparatus of claim 19 including:

a cam member which is actuated to an operative position to push the innersprings past the borderwires in the transverse direction as an incident of said downstream travel of the spring assembly; and a sensor which detects the spring assembly for shifting the cam member from an inoperative position thereof to its operative position with the cam member staying in the operative position until the drive mechanism has advanced an entire side or end of the mattress spring assembly past the lifting mechanism.

22. The apparatus of claim 21 wherein the cam member comprises an arm having an arcuate portion for engaging ends of the innersprings and progressively urging them past the borderwires in the transverse direction as the drive mechanism advances the spring assembly through the positioning station.

23. The apparatus of claim 22 wherein the arm includes a straight portion downstream from the arcuate portion with the arm in the operative position to keep the innerspring pushed past the borderwires as the spring assembly advances to the applicator tool.

24. An apparatus for automatically applying clips to mattress spring assemblies including borderwires extending about mattress innersprings, the apparatus comprising:

a frame including portions for supporting spring assemblies in a generally vertical orientation;

a drive mechanism which advances spring assemblies in their vertical orientation in a downstream travel direction along the frame for being clipped;

a clipping station including at least one applicator tool for securing clips about borderwires and innersprings for clipping the spring assembly together;

a positioning station upstream from the clipping station including at least one operating member which is actuated to an operative position to push the innersprings past the borderwires in a direction transverse to the downstream direction as the spring assembly is traveling in said downstream travel direction through the positioning station; and a sensor which detects the spring assembly for shifting the it operating member from an inoperative position thereof to its operative position with the operating member staying in the operative position until the drive mechanism has advanced an entire side or end of the mattress spring assembly through the positioning station.

25. The apparatus of claim 24 wherein the operating member comprises an arm having an arcuate portion for engaging the innersprings and progressively urging them past the borderwires in the transverse direction as the drive mechanism advances the spring assembly through the positioning station.

26. The apparatus of claim 25 wherein the arm includes a straight portion downstream from the arcuate portion with the arm in the operative position to keep the innerspring pushed past the borderwires as they exit the positioning station.

27. The apparatus of claim 25 wherein the at least one operating member comprises a pair of arms mounted relative to the frame so that the mattress spring assembly is advanced between the arms with the respective arms pushing the innersprings in oppositely directed transverse directions, and a pair of fingers each mounted adjacent one of the arms operable to restrain the borderwires in a substantially fixed transverse position as advanced through the positioning station.

28. The apparatus of claim 25 wherein the sensor is disposed upstream of the clipping station, and a controller for receiving a signal from the sensor indicating detection of the spring assembly and using a time delay or distance measurement before actuating the applicator tool for allowing the drive mechanism to advance the spring assembly downstream to the clipping station.

29. The apparatus of claim 24 wherein the at least one operating member includes at least one finger having an operative position and a restraining portion which keeps the borderwires from being shifted with the pushed innersprings with the finger in the operative position.

30. The apparatus of claim 29 including a sensor for detecting the spring assembly and disposed downstream of the finger and signaling the controller for operating the finger to remain in an inoperative position until the leading preclipped corner innersprings of the spring assembly travel past the finger.

31. A method for automatically securing borderwires to opposite end of innersprings of mattress spring assemblies, the method comprising:

providing a preclipped spring assembly having the ends of corner innersprings clipped to the borderwires;

advancing the spring assembly in a substantially vertical orientation in a downstream travel direction so that axes of the innersprings that extend between the opposite ends thereof are oriented transverse to the travel direction;

progressively shifting the ends of the innersprings in a direction transverse to the travel direction as the spring assembly advances in the travel direction for orienting the innerspring ends and borderwires in a predetermined clipping orientation; and clipping the ends of the innersprings to the borderwires in their predetermined clipping orientation.

32. The method of claim 31 wherein the innerspring ends are progressively shifted in the transverse direction by raising portions of the innersprings intermediate the ends thereof and drawing the innerspring ends toward each other.

33. The method of claim 31 including lifting the innerspring ends up and over the borderwires to shift the ends toward the predetermined clipping orientation.

34. The method of claim 31 wherein the innerspring ends are progressively shifted in the transverse direction by raising portions of the innersprings intermediate the ends thereof and pushing the ends in the transverse direction as the spring assembly travels in the downstream direction.

35. The method of claim 34 including lowering the innersprings so that the ends and borderwires are in the predetermined clipping orientation and guiding the shifted innerspring ends to maintain the predetermined clipping orientation for clipping.

36. The method of claim 31 including restraining the borderwires from shifting in the transverse direction so that the progressive pushing of the ends of the innersprings pushes the innerspring ends against and past the restrained borderwires into a predetermined clipping orientation.

37. The method of claim 36 the innerspring ends are progressively pushed and the borderwires are restrained by operating members in operative positions thereof, and maintaining the operating members in their operative positions until the unclipped innersprings along an entire side or end of the spring assembly have been clipped to the borderwires.

38. The method of claim 31 including maintaining the ends of the innersprings at a substantially predetermined transverse position against shifting away from each other during continued downstream travel of the spring assembly after the innerspring ends have been progressively pushed in the transverse direction for being clipped to the borderwires.

* * * * *

UNITED STATES PATENT AND TRADEMARK OFFICE

CERTIFICATE OF CORRECTION

PATENT NO. : 6,374,495 B1
DATED : April 23, 2002
INVENTOR(S) : Lackler et al.

It is certified that error appears in the above-identified patent and that said Letters Patent is hereby corrected as shown below:

Column 19,
Line 13; delete "The apparatus of claim 19" and insert
-- An apparatus for automatically applying clips to mattress spring assemblies including borderwires extending about ends of mattress innersprings, the apparatus comprising:
a frame including portions for supporting spring assemblies in a generally vertical orientation;
a drive mechanism which advances spring assemblies in their vertical orientation in a downstream travel direction along the frame for being clipped;
a clipping station including at least one applicator tool for securing clips about borderwires and innerspring ends for clipping the spring assembly together; and
a lifting mechanism upstream of the clipping station for raising portions of the innerspring intermediate the ends thereof to shift the ends past the borderwires in a direction transverse to the downstream direction, --
Line 16, after "as" delete "an incident of the downstream travel of".
Line 17, after "spring assembly", insert -- is traveling in the downstream direction. --
Line 18, delete "The apparatus of claim 19 including:" and insert -- An apparatus for automatically applying clips to mattress spring assemblies including borderwires extending about ends of mattress innersprings, the apparatus comprising:
a frame including portions for supporting spring assemblies in a generally vertical orientation;
a drive mechanism which advances spring assemblies in their vertical orientation in a downstream travel direction along the frame for being clipped;
a clipping station including at least one applicator tool for securing clips about borderwires and innerspring ends for clipping the spring assembly together;
a lifting mechanism upstream of the clipping station for raising portions of the innerspring intermediate the ends thereof to shift the ends past the borderwires in a direction transverse to the downstream direction; --
Line 21, after "as" delete "an incident of the downstream travel of".
Line 22, after "assembly" insert -- is traveling in the downstream direction --.
Line 60, before "operating" delete "it".

UNITED STATES PATENT AND TRADEMARK OFFICE

CERTIFICATE OF CORRECTION

PATENT NO. : 6,374,495 B1
DATED : April 23, 2002
INVENTOR(S) : Lackler et al.

It is certified that error appears in the above-identified patent and that said Letters Patent is hereby corrected as shown below:

Column 20,
Line 39, change "end" to -- ends --.

Signed and Sealed this

Tenth Day of December, 2002

JAMES E. ROGAN
*Director of the United States Patent and Trademark Office*